US006245497B1

(12) United States Patent
Eikenberry et al.

(10) Patent No.: US 6,245,497 B1
(45) Date of Patent: Jun. 12, 2001

(54) PERFORMANCE OF HIGH SPEED EMULSIONS FOR COLOR FILM

(75) Inventors: Jon N. Eikenberry; David T. Southby, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/467,200

(22) Filed: Dec. 20, 1999

(51) Int. Cl.[7] ..... G03C 1/08; G03C 7/26; G03C 7/32

(52) U.S. Cl. ..... 430/553; 430/955; 430/555; 430/557; 430/558; 430/567; 430/570; 430/598; 430/599; 430/600; 430/603; 430/607; 430/611; 430/613

(58) Field of Search ..... 430/543, 955, 430/553, 555, 557, 558, 567, 570, 572, 577, 580, 583, 584, 588, 593, 594, 598, 599, 600, 603, 607, 611, 613

(56) References Cited

U.S. PATENT DOCUMENTS

| | | | | |
|---|---|---|---|---|
| 4,184,877 | | 1/1980 | Maternaghan . | |
| 4,668,614 | | 5/1987 | Takada et al. . | |
| 4,728,602 | | 3/1988 | Shibahara et al. | 430/567 |
| 4,963,467 | | 10/1990 | Ishkawa et al. | 430/567 |
| 5,612,173 | * | 3/1997 | Proehl et al. | 430/504 |
| 5,747,235 | * | 5/1998 | Farid et al. | 430/583 |
| 5,830,632 | * | 4/2000 | Chari et al. | 430/546 |
| 6,010,841 | * | 1/2000 | Farid et al. | 430/583 |
| 6,054,260 | * | 4/2000 | Adin et al. | 430/583 |

* cited by examiner

*Primary Examiner*—Geraldine Letscher
(74) *Attorney, Agent, or Firm*—Edith A. Rice

(57) ABSTRACT

A photographic element comprises a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said emulsion layers comprises a) an emulsion with 3D, core/shell grains of at least 0.40 μm average diameter having a high iodide content in the core of the grain with a shell containing a lesser amount of iodide, b) a one-equivalent image-dye forming coupler, and c) a fragmentable electron donating compound of the formula: X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y'; and, optionally, 3) the radical $X^{\bullet}$ has an oxidation potential $\leqq -0.7V$ (that is, equal to or more negative than about −0.7V).

34 Claims, No Drawings

PERFORMANCE OF HIGH SPEED EMULSIONS FOR COLOR FILM

FIELD OF THE INVENTION

This invention relates to a color photographic element having improved photographic response. In particular, it relates to a high speed emulsion with improved performance for use in a color film.

DEFINITIONS

A 3D emulsion is one in which at least 50 percent of total grain projected area is accounted for by 3D grains. As used herein, the term "3D grain" refers to non-tabular morphologies, for example cubes, octahedra, rods and spherical grains, and to tabular grains having an aspect ratio of less than 2.

A core/shell emulsion as used herein is a bromoiodide emulsion with at least one inner or "core" region containing a higher iodide concentration than an outer or "shell" region.

A fragmentable electron donor (FED) is a chemical compound that enhances the sensitivity of the emulsion through fragmentation of the molecule and release of an electron.

As used herein, the term "one equivalent couplers" refers to imaging couplers where a preformed dye in a shifted state is linked to the coupling position of the coupler. The dye image comprises the coupler derived azomethine dye and the released dye that have essentially the same hue.

BACKGROUND OF THE INVENTION

It is a long-standing objective of color photographic origination materials to maximize the overall response to light while maintaining the lowest possible granularity. Increased photographic sensitivity to light (commonly referred to as photographic speed) allows for improved images captured under low light conditions or improved details in the shadowed regions of the image. In general, the overall light sensitivity provided by the light sensitive silver halide emulsions in such systems is determined by the grain size of the emulsions. Larger emulsions capture more light. In color photographic elements, upon development, the captured light is ultimately converted into dye deposits which constitute the reproduced image. However, the granularity expressed by these dye deposits is directly proportional to the grain size of the silver halide emulsion. Thus, larger silver halide emulsion grains have higher sensitivity to light but also lead to higher granularity in the reproduced image. It has been a long-standing problem to provide materials which maximize the response to light of a silver halide emulsion for any given grain size.

3D, core/shell bromide emulsions containing high iodide regions have long been a staple of the blue-sensitive layer in color film. Their intrinsic light absorption in the blue region together with their low response to pressure, continue to make them an attractive choice, especially as the fast component. Recent techniques have been developed to improve the photographic performance of such emulsions by introducing twin planes (Matemaghan in U.S. Pat. No. 4,184,877), producing grains with a particular iodide architecture (Takada et al in U.S. Pat. No. 4,668,614, Ishikawa et al in U.S. Pat. No. 4,963,467), narrowing the range of iodide in individual grains (Shibahara et al in U.S. Pat. No. 4,728,602), and growing grains free of renucleation while obtaining a narrow distribution of grains with a high iodide content (Chang et al, U.S. Pat. No. 5,570,327). Although these techniques have, indeed, increased performance of core/shell emulsions there continues to be a need for further improvements to yield color film with the highest possible image quality for the consumer.

It is of particular interest to find solutions to this problem for large emulsions with the potential for providing high speed (preferably ISO 400 or greater) color photographic materials. Such high-speed materials have a number of potential applications. They are particularly valuable for use in cameras with zoom lenses and in single use cameras (also called "film with lens" units). Zoom lenses generally are limited to smaller apertures than non-zoom lenses, which reduces light intensity. Thus, zoom lenses, while giving increased flexibility in composition of a pictorial scene, deliver less light to the camera film plane. Use of high-speed films allows the flexibility of zoom lenses while still preserving picture-taking opportunities at low light levels. In single use cameras, lens focus is fixed. Here, high-speed films allow use of a fixed aperture having a higher f-number, thus increasing the available depth of field, an important feature in a fixed focus camera. For single use cameras with flash, higher film speed allows pictures to be taken with a less energetic flash, enabling more economical manufacture of the single use unit. The introduction of the Advanced Photo System has further increased demand on film image quality by reducing camera size and, concomitantly, the size of the image-capturing element.

3D, core/shell emulsions, while capable of the highest speeds of any emulsion type in the blue record, have the particular disadvantage of producing a relatively low contrast where contrast is defined as the slope or gradient of the linear portion of the density vs. log exposure or D-Log E curve. The low contrast originates chiefly from two sources: the relatively wide dispersity in grain size characteristic of large, grains and the high iodide content of the grains. Both of these features, i.e., large grain size and high iodide content are required to obtain the greatest possible blue speed and, therefore, are inherent in this type of emulsion. A need, thus, exists for an additional and independent technique for improving performance.

PROBLEM TO BE SOLVED BY THE INVENTION

The problem of maximizing response of the emulsion grain to light is particularly important for the blue sensitive emulsions of high-speed materials, since standard scene illuminants are at least somewhat deficient in blue light. Furthermore, the blue record is the last color-recording layer coated in conventional color film putting it near the top where it is most effected by inadvertent pressure applied to the film. As a result, 3D, core/shell, AgBrI emulsions with light absorption enhanced by high iodide content and having low pressure sensitivity are generally employed in the fast yellow emulsion layer of the highest speed color photographic films. Unfortunately, these large fast yellow emulsions often do not deliver enough contrast in their response to light.

SUMMARY OF THE INVENTION

We have discovered that adding a fragmentable electron donor to an emulsion comprising 3D, core/shell grains and utilizing a one equivalent coupler in the layer containing these grains enables these emulsions to simultaneously achieve improved speed and contrast.

One aspect of this invention comprises a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said layers comprises a) an emulsion with 3D, core/shell grains of at least 0.40 μm average diameter having a high iodide content in the core of the grain with a shell containing a lesser amount of iodide, b) a one-equivalent image-dye forming coupler, and c) a fragmentable electron donating compound of the formula: X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y'; and, optionally, 3) the radical $X^{\bullet}$ has an oxidation potential $\leqq -0.7V$ (that is, equal to or more negative than about −0.7V).

The unexpected result of the combination of a 3D, core/shell emulsion with an FED compound and a one-equivalent coupler is the observation of a larger speed gain than the sum of the speed gains obtained by the separate addition of an FED compound and a one-equivalent coupler while at the same time delivering an approximate two-fold increase in contrast.

ADVANTAGEOUS EFFECT OF THE INVENTION 3D, core/shell emulsions used in accordance with this invention provide the highest blue speed with a low response to pressure. The improved contrast permits the coating of less silver or it can be utilized to provide improved inter-image effects leading to higher saturated colors.

DETAILED DESCRIPTION OF THE INVENTION

The invention utilizes 3D emulsions characterized by having a high iodide content in the core of the grain with a shell containing a lesser amount of silver iodide. The emulsion is treated with an FED compound and coated with a one-equivalent image-dye forming coupler to yield the desired performance. Useful emulsions in this application include silver bromoiodide emulsions with core regions in which the silver halide content is preferably from about 5 to about 40% silver iodide. Especially useful are those emulsions with cores of from about 10 to about 40% silver iodide. The core is preferably about 5 to about 60% of the total grain volume. Especially useful are those with a core of about 10 to about 50 %. The silver halide content of the shell region is preferably 0 to about 10% silver iodide but in all cases, the silver iodide in the shell is less than that in the core. Especially useful are emulsions in which the silver halide content of the shell from about 1 to about 6% silver iodide. The total silver iodide of the emulsion can range from about 2 to about 15%. Iodide analysis can be performed using X-ray powder diffraction as described by Blanton in *Industrial Applications of X-Ray Diffraction,* Chapter 25, 1999. The average size of the emulsion is at least 0.4 μm equivalent circular diameter, preferably at least 0.8 μm equivalent circular diameter, and most preferably at least 1.0 μm equivalent circular diameter.

The silver halide grains to be used in the invention may be prepared according to methods known in the art, such as those described in *Research Disclosure,* September 1996, Number 389, Item 38957, which will be identified hereafter by the term "Research Disclosure I and James, *The Theory of the Photographic Process.* (Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND.) These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure,* Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexa-coordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

Although generally preferred concentration ranges for the various SET and non-SET Ir dopants have been set out above, it is recognized that specific optimum concentration ranges within these general ranges can be identified for specific applications by routine testing. It is specifically contemplated to employ the SETand non-SET Ir dopants singly or in combination. For example, grains containing a combination of an SET dopant and a non-SET Ir dopant are specifically contemplated.

The photographic elements Df the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I,* Section IV (pages 510–511) and the references cited therein.

In accordance with this invention the silver halide emulsion contains a fragmentable electron donating (FED) compound which enhances the sensitivity of the emulsion. The fragmentable electron donating compound is of the formula X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^\bullet$ and the leaving fragment Y';

and, optionally, 3) the radical $X^\bullet$ has an oxidation potential $\leqq -0.7$V (that is, equal to or more negative than about −0.7V).

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents "volts versus a saturated calomel reference electrode".

In embodiments of the invention in which Y' is Y, the following represents the reactions that are believed to take place when X—Y undergoes oxidation and fragmentation to produce a radical $X^\bullet$, which in a preferred embodiment undergoes further oxidation.

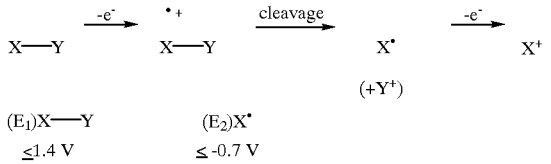

where $E_1$ is the oxidation potential of X—Y and $E_2$ is the oxidation potential of the radical $X^\bullet$.

$E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

In certain embodiments of the invention the oxidation potential, $E_2$, of the radical $X^\bullet$ is equal to or more negative than -0.7V, preferably more negative than about −0.9 V. $E_2$ is preferably in the range of from about −0.7 to about −2 V, more preferably from about −0.8 to about −2 V and most preferably from about −0.9 to about −1.6 V.

The structural features of X-Y are defined by the characteristics of the two parts, namely the fragment X and the fragment Y. The structural features of the fragment X determine the oxidation potential of the X-Y molecule and that of the radical $X^\bullet$, whereas both the X and Y fragments affect the fragmentation rate of the oxidized molecule $X—Y^{\bullet+}$.

In embodiments of the invention in which Y' is H, the following represents the reactions believed to take place when the compound X—H undergoes oxidation and deprotonation to the base, $\beta^-$, to produce a radical $X^\bullet$, which in a preferred embodiment undergoes further oxidation.

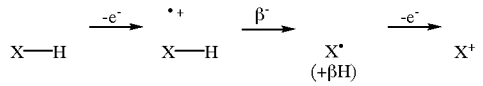

Preferred X groups are of the general formula:

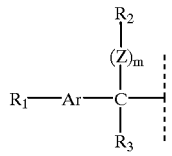

(I)

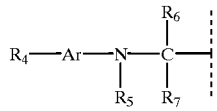

(II)

-continued (III)

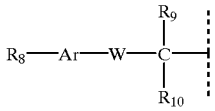

(IV)

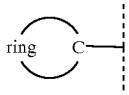

The symbol "R" (that is R without a subscript) is used in all structural formulae in this patent application to represent a hydrogen atom or an unsubstituted or substituted alkyl group.

In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar;

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$ =R, Ar'

$R_6$ and $R_7$ =R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar' =aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$ =R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

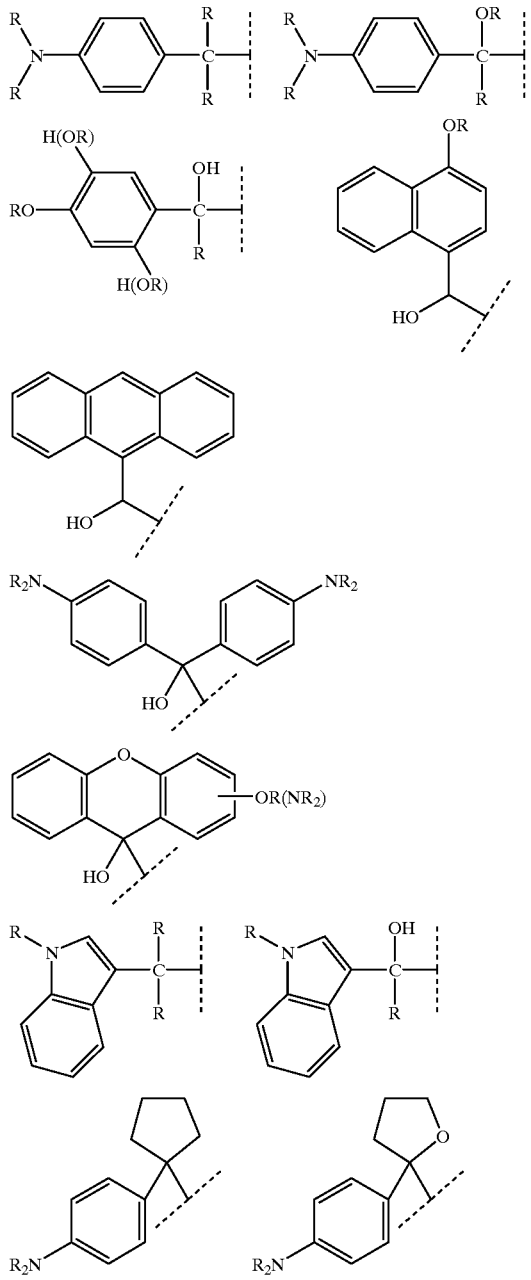

-continued

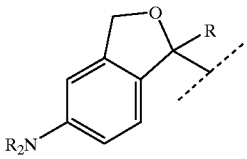

In the structures of this patent application a designation such as —OR($NR_2$) indicates that either —OR or —$NR_2$ can be present.

The following are illustrative exanples of the group X of general structure II:

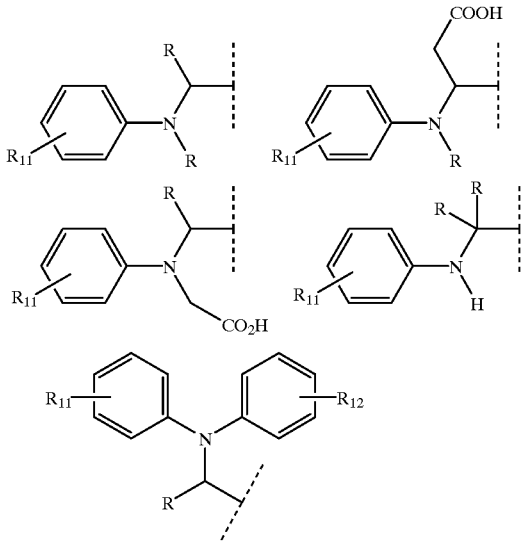

$R_{11}$ and $R_{12}$ = { H, alkyl, alkyloxy, alkylthio, halo, carbamoyl; carboxyl, amido, formyl, sulfonyl, sulfonamido, nitrile }

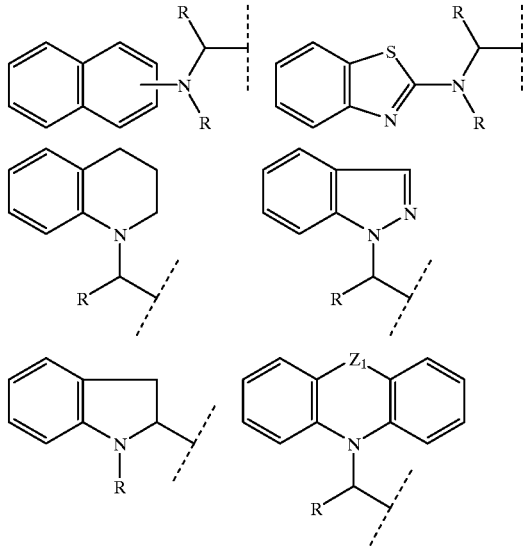

$Z_1$=a covalent bond, S, O, Se, NR, $CR_2$, CR=CR, or $CH_2CH_2$.

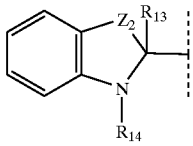

$Z_2$=S, O, Se, NR, $CR_2$, CR═CR, $R_{13}$,=alkyl, substituted alkyl or aryl, and $R_{14}$=H, alkyl substituted alkyl or aryl.

The following are illustrative examples of the group X of the general structure III:

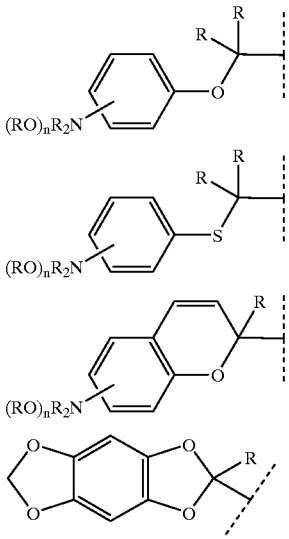

n=1–3

The following are illustrative examples of the group X of the general structure IV:

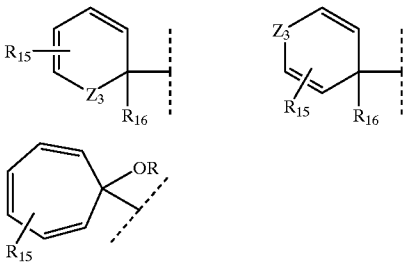

$Z_3$=O, S, Se, NR $R_{15}$=R, OR, $NR_2$ $R_{16}$=alkyl, substituted alkyl

Preferred Y' groups are:

(1) X', where X' is an X group as defined in structures I–IV and may be the same as or different from the X group to which it is attached

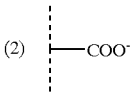

-continued (3) 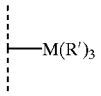

where M=Si, Sn or Ge; and R'=alkyl or substituted alkyl (4) 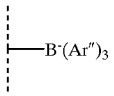

where Ar"=aryl or substituted aryl (5) 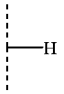

In preferred embodiments of this invention Y' is —H, —COO— or —Si(R')$_3$ or —X'. Particularly preferred Y' groups are —H, —COO— or —Si(R')$_3$.

In embodiments of the invention in which Y' is a proton, a base, $\beta^-$, is covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

TABLE I

| pKa's in water of the conjugate acids of some useful bases | |
|---|---|
| $CH_3—CO_2^-$ | 4.76 |
| $C_2H_5—CO_2^-$ | 4.87 |
| $(CH_3)_2CH—CO_2^-$ | 4.84 |
| $(CH_3)_3C—CO_2^-$ | 5.03 |
| $HO—CH_2—CO_2^-$ | 3.83 |
| 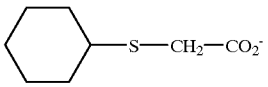 | 3.48 |
| $CH_3—CO—NH—CH_2—CO_2^-$ | 3.67 |
| 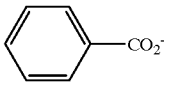 | 4.19 |
| 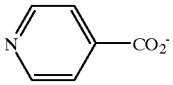 | 4.96 |
| $CH_3—COS^-$ | 3.33 |
| 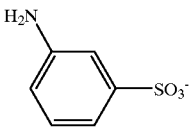 | 3.73 |

TABLE I-continued

| pKa's in water of the conjugate acids of some useful bases | |
|---|---|
| 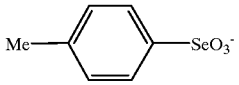 | 4.88 |
| 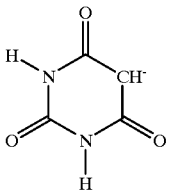 | 4.01 |
| 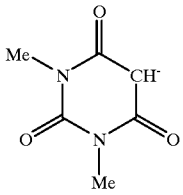 | 4.7 |
| $(CH_3)_3N^+—O^-$ | 4.65 |
| 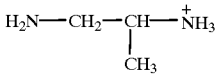 | 6.61 |
| 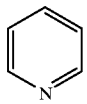 | 5.25 |
| 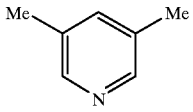 | 6.15 |
| 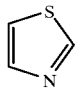 | 2.44 |
| 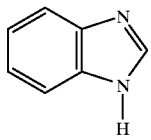 | 5.53 |

Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absorptive group, A, directly or indirectly attached to X, or a chromophore forming group, Q, which is attached to X. Such fragmentable electron donating compounds are preferably of the following formulae:

$$Z—(L—X—Y')_k$$

$$A—(L—X—Y')_k$$

$$(A—L)_k—X—Y'$$

Q—X—Y'

A—(X—Y')$_k$ (A)$_k$—X—Y'

Z—(X—Y')$_k$ or (Z)$_k$—X—Y'

Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

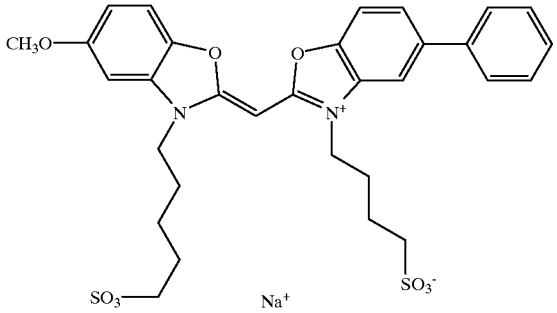

Dye 2

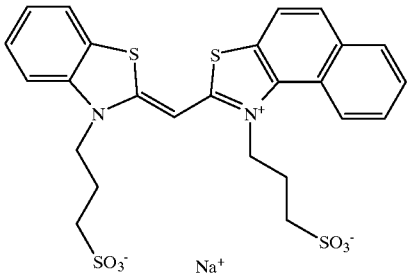

Dye 3

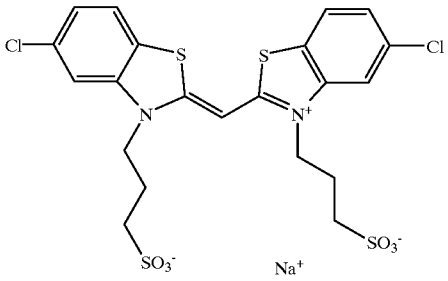

-continued

Dye 4

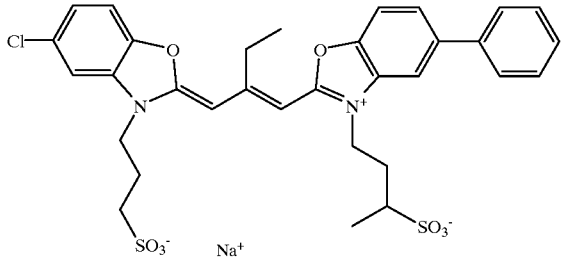

Dye 5

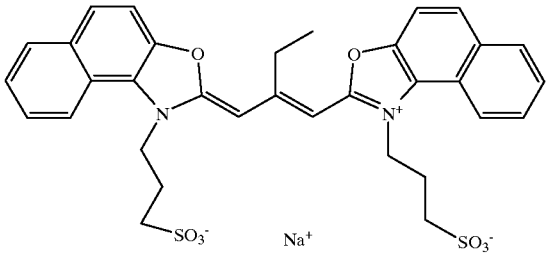

Dye 6

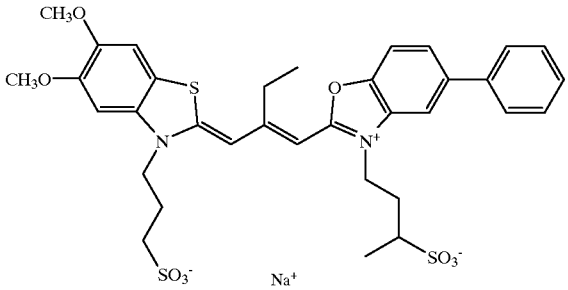

Dye 7

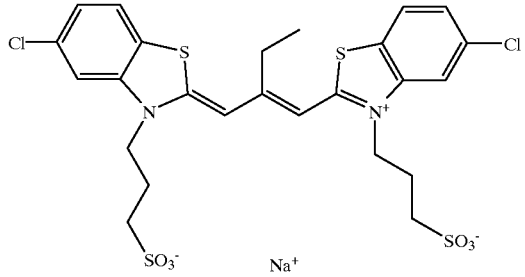

and

Dye 8

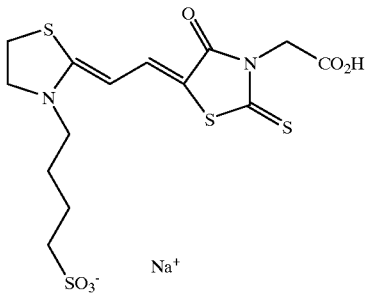

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

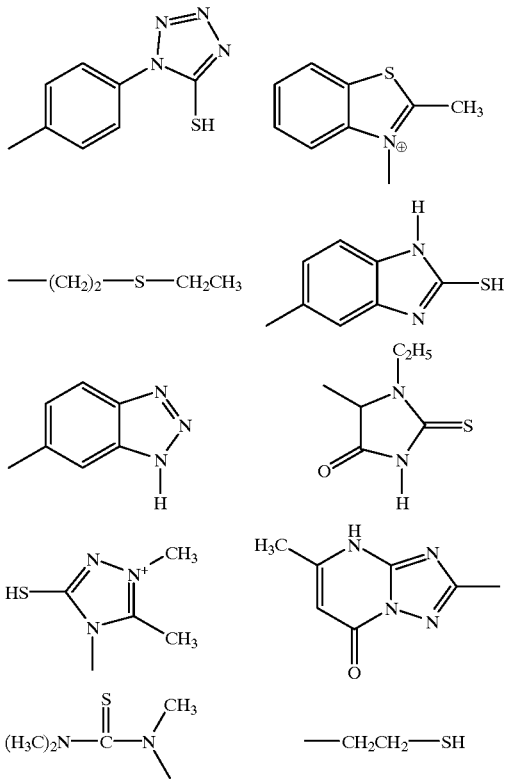

and

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects by a covalent bond the light absorbing group Z or the silver halide adsorbing group A to the fragmentable electron donating group XY is preferably an organic linking group containing a least one C, N, S, or 0 atom. It is also desired that the linking group not be completely aromatic or unsaturated, so that a pi-conjugation system cannot exist between the Z and XY or the A and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

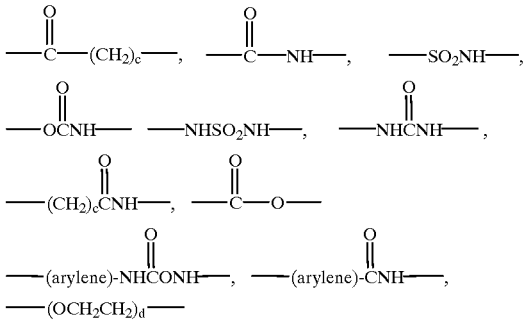

where c=1–30, and d=1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

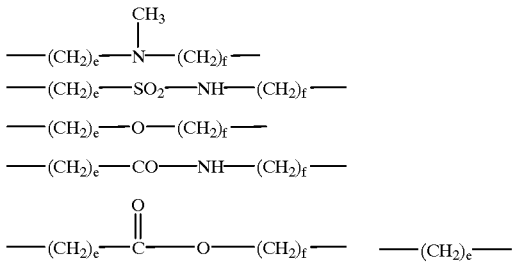

e and f=1–30, with the proviso that e+f≦31

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

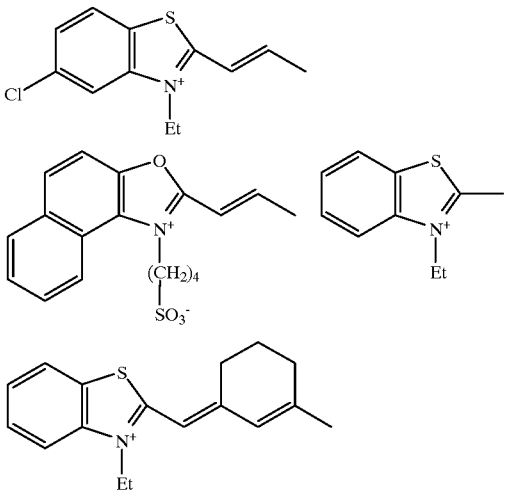

-continued

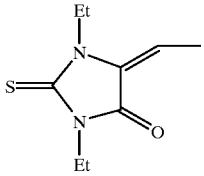

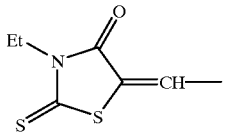

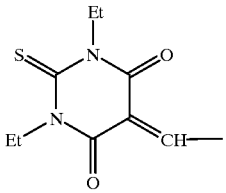

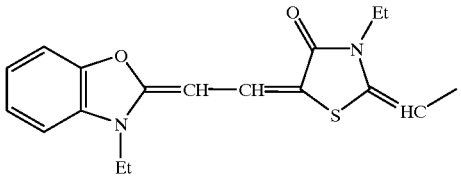

Particularly preferred are Q groups of the formula:

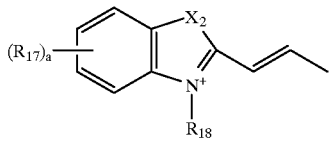

wherein:

$X_2$ is O, S, N, or $C(R_{19})_2$, where $R_{19}$ is substituted or unsubstituted alkyl.

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating compounds include:

FED 1

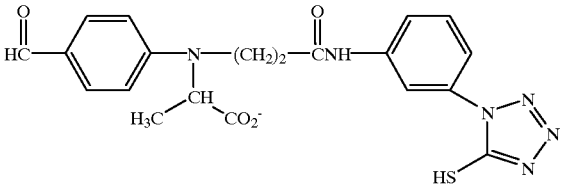

FED 2

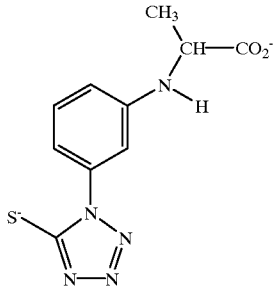

FED 3

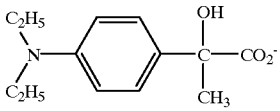

FED 4

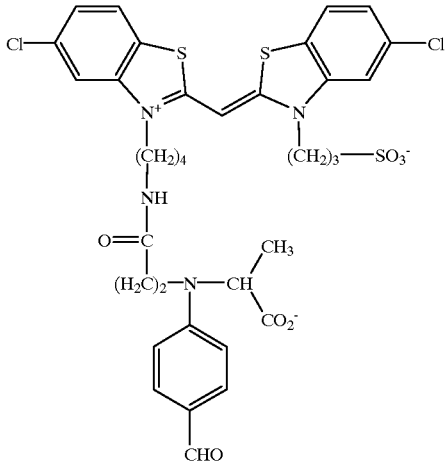

-continued
FED 5
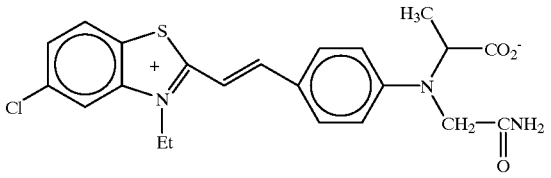
FED 6
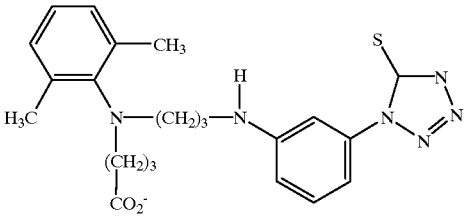
FED 7
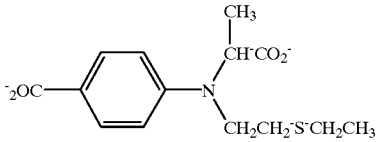
FED 8
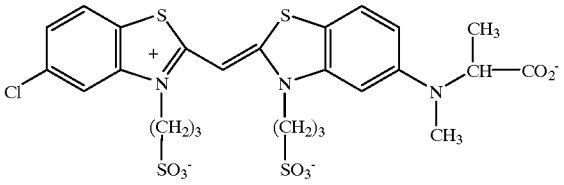
FED 9
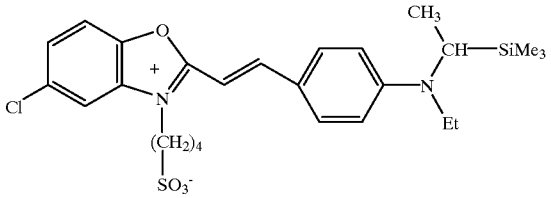
FED 10
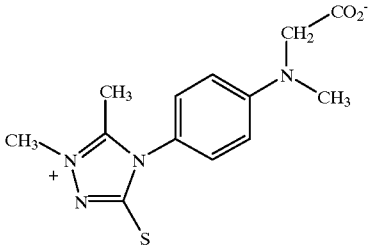
FED 11
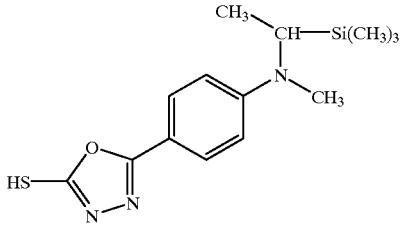
FED 12
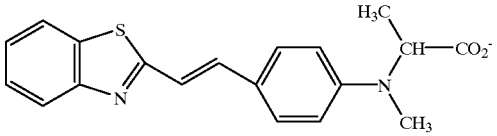
FED 13
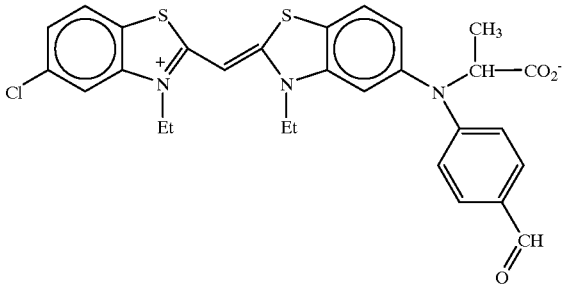
FED 14
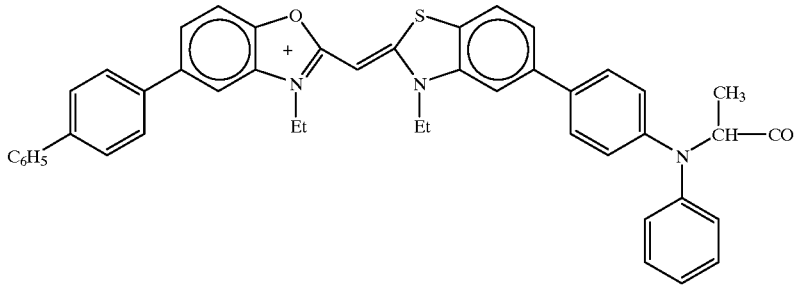

-continued

FED 15

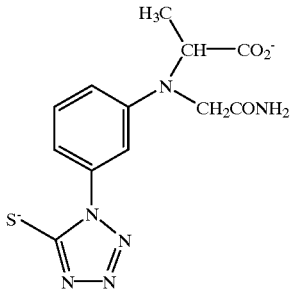

FED 16

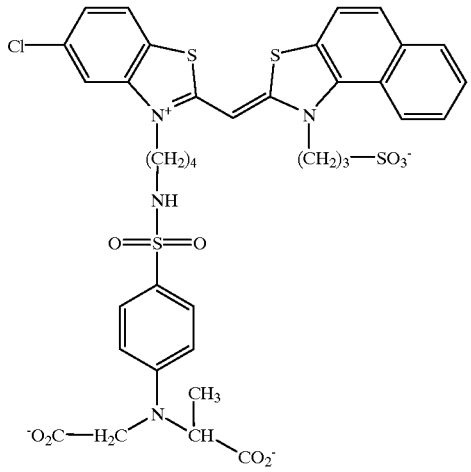

FED 17

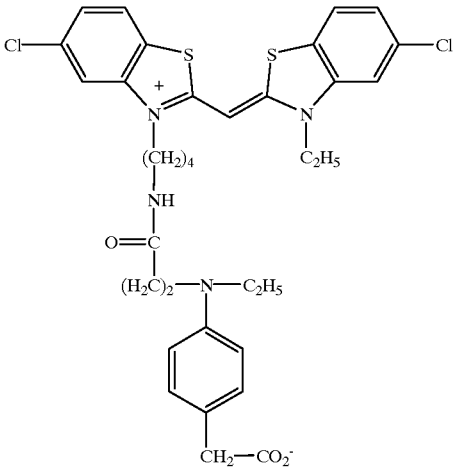

FED 18

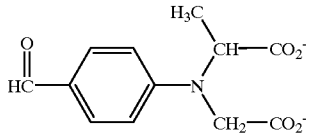

FED 18

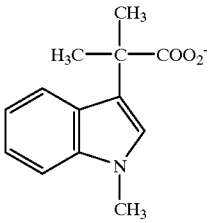

FED 20

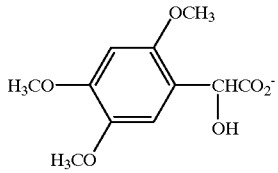

FED 21

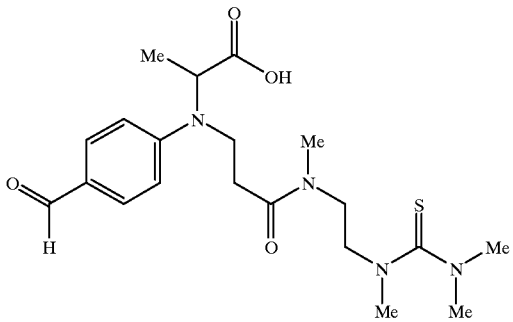

FED 22

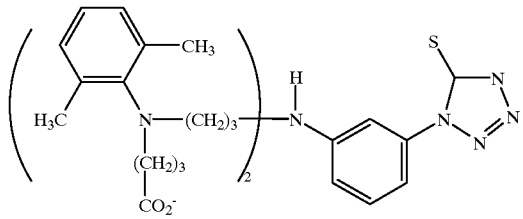

The fragmentable electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye. The amount of electron donor which is employed in this invention may range from as little as $1\times10^{-8}$ mole per mole of silver in the emulsion to as much as about 0.1 mole per mole of silver, preferably from about $5\times10^{-7}$ to about 0.05 mole per mole of silver. Where the oxidation potential $E_1$ for the XY moiety of the electron donating sensitizer is a relatively low potential, it is more active, and relatively less agent need be employed. Conversely, where the oxidation potential for the XY moiety of the electron donating sensitizer is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating sensitizer is more closely associated with the silver halide grain and relatively less agent need be employed. For fragmentable one-electron donors relatively larger amounts per mole of silver are also employed. Although it is preferred that the fragmentable electron donor be added to the silver halide emulsion prior to manufacture of the coating, in certain instances, the electron donor can also be incorporated into the emulsion after exposure by way of a pre-developer bath or by way of the developer bath itself.

Fragmentable electron donating compounds are described more fully in U.S. Pat. Nos. 5,747,235 and 5,747,236 and commonly assigned co-pending U.S. applications Ser. No. 08/739,911 filed Oct. 30, 1996, and Ser. Nos. 09/118,536, 09/118,552 and 09/118,714 filed Jul. 25, 1998, the entire disclosures of these patents and patent applications are incorporated herein by reference.

The dye image forming layer unit which contains the fragmentable electron donating compound also contains one or more one-equivalent image dye-forming couplers. As herein employed, the term "coupler" is employed in its art recognized sense of denoting a compound that reacts with a quinonediimine derived from an oxidized p-phenylenediamine color developing agent during photographic element development to perform a photographically useful function. A one equivalent image dye-forming coupler can be viewed as a two or four equivalent image dye-forming coupler modified to contain a leaving group that (a) provides the activation for coupling of leaving groups found in two equivalent image dye-forming couplers and (b) contains a dye chromophore capable of contributing to dye image density. In other words, one equivalent image dye-forming couplers can be viewed as being made up of conventional coupling moieties (COUP) of the type found in image dye-forming couplers generally and leaving moieties (LG) that are specifically selected to impart one equivalent coupling.

The image dye-forming couplers are summarized in *Research Disclosure,* Item 38957, X. Dye image formers and modifiers, B. Image-dye-forming couplers contain coupling moieties COUP of the type found in the one equivalent image dye-forming couplers contemplated for use in the image dye forming layer units of the photographic elements of this invention. Although many varied forms of COUP moieties are known, most COUP moieties have been synthesized to facilitate formation of image dyes having their main absorption in the red, green, or blue region of the visible spectrum.

For example, couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999; and "Farbkuppler: Eine Literaturubersicht," published in Agfa Mitteilungen, Band III, pp. 156–175 (1961). In the coupler moiety COUP structures shown below, the unsatisfied bond indicates the coupling position to which the leaving moiety LG is attached.

Preferably such cyan dye-forming couplers are phenols and naphthols which form cyan dyes on reaction with oxidized color developing agent at the coupling position, i.e. the carbon atom in the 4-position of the phenol or naphthol. Preferred COUP moieties of the type found in cyan dye-forming couplers are:

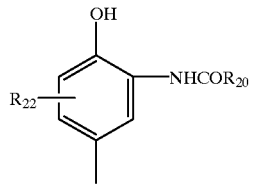

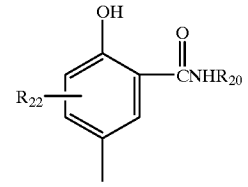

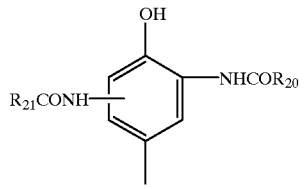

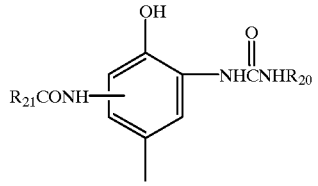

and

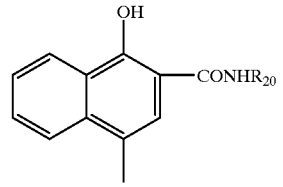

wherein $R^{20}$ and $R^{21}$ can represent a ballast group or a substituted or unsubstituted alkyl or aryl group, and $R^{22}$ represents one or more halogen (e.g. chloro, fluoro), alkyl having from 1 to 4 carbon atoms or alkoxy having from 1 to 4 carbon atoms.

Couplers which form magenta dyes upon reaction with oxidized color developing agent are described in such representative patents and publications as: U.S. Pat. Nos. 2,600,788; 2,369,489; 2,343,703; 2,311,082; 3,824,250; 3,615, 502; 4,076,533; 3,152,896; 3,519,429; 3, 062,653; 2,908, 573; 4,540,654; and "Farbkuppler: Eine Literaturubersicht," published in Agfa Mitteilungen, Band III, pp. 126–156 (1961).

Preferably such magenta dye-forming couplers are pyrazolones and pyrazolotriazoles which form magenta dyes upon reaction with oxidized color developing agents at the coupling position—i.e., the carbon atom in the 4-position for pyrazolones and the 7-position for pyrazolotriazoles. Preferred COUP moieties of the type found in magenta dye-forming couplers are:

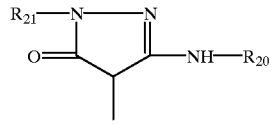

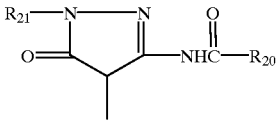

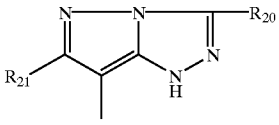

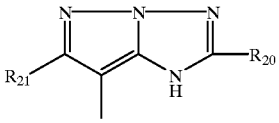

and

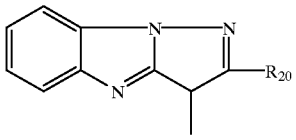

wherein $R^{20}$ and $R^{21}$ are as defined above. $R^{21}$ for pyrazolone structures is typically phenyl or substituted phenyl, such as, for example, 2,4,6-trihalophenyl, and for the pyrazolotriazole structures $R^{21}$ is typically alkyl or aryl.

Couplers which form yellow dyes upon reaction with oxidized color developing agent are described in such representative patents and publications as: U.S. Pat. Nos. 2,875, 057; 2,407,210; 3,265,506; 2,298,443; 3,048,194; 3, 447, 928; and "Farbkuppler: Eine Literaturubersicht," published in Agfa Mitteilungen, Band III, pp. 112–126 (1961).

Preferably such yellow dye-forming couplers are acylacetamides, such as benzoylacetanilides and pivalylacetanilides. These couplers react with oxidized developer at the coupling position—i.e., the active methylene carbon atom. Preferred COUP moieties of the type found in yellow dye-forming couplers are:

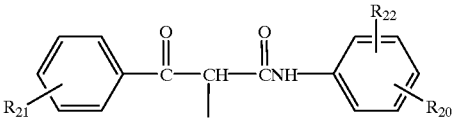

and

-continued

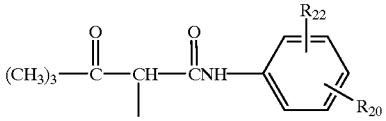

wherein $R^{20}$ and $R^{21}$ are as defined above and can also be hydrogen, alkoxy, alkoxycarbonyl, alkanesulfonyl, arenesulfonyl, aryloxycarbonyl, carbonamido, carbamoyl, sulfonamido, or sulfamoyl, and $R^{22}$ is hydrogen or one or more halogen, lower alkyl (e.g. methyl, ethyl), lower alkoxy (e.g., methoxy, ethoxy), or a ballast (e.g. alkoxy of 16 to 20 carbon atoms) group.

Other preferred COUP moieties of the type found in yellow dye-forming couplers are of the formula:

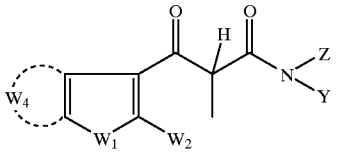

or

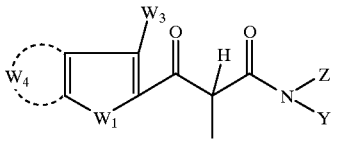

wherein:

$W_1$ is a heteroatom or heterogroup, preferably —NR—, —O—, —S—, —$SO_2$—;

$W_2$ is H, or a substituent group, such as an alkyl or aryl group;

$W_3$ is H, or a substituent group, such as an alkyl or aryl group;

$W_4$ represents the atoms necessary to form a fused ring with the ring containing $W_1$, preferably a benzo group;

Y and Z are independently H or a substituent group, preferably Y is H and Z is a substituted phenyl group.

Other preferred COUP moieties of the type found in yellow dye-forming couplers are of the formula:

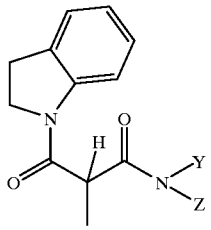

or

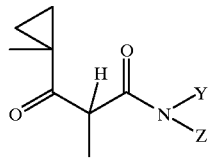

wherein Y and Z are as defined above. The leaving group LG differs from the leaving groups of two equivalent image dye-forming couplers in that LG itself contains a dye chromophore. If the dye chromophore of LG exhibits the same hue before and after separation from COUP, it does not contribute to forming a dye image, but simply increases dye density uniformly in all image areas. To obtain a desired image dye light absorption when LG is released from COUP while avoiding unwanted light absorption by the dye chromophore in LG when LG remains attached to COUP, conventional LG constructions are chosen to produce a bathochromic shift of light absorption in released LG as compared to COUP attached LG. For example, assuming that a yellow (blue light absorbing) dye image is sought, LG can be constructed to contain an ultraviolet absorbing dye chromophore when attached to COUP, and release from COUP can result in shifting absorption bathochromically into the blue region of the spectrum, thereby changing the perceived hue of the LG incorporated dye from essentially colorless to yellow. With LG constructions permitting longer wavelength bathochromic shifts, the LG hue can shift from essentially colorless (UV absorbing) to green or even red. For green and red absorbing dyes in released LG, it is recognized that initial (COUP attached) LG absorption may, depending upon the construction chosen, extend into the visible region of the spectrum. This initially visible absorption is lost when LG is released. The loss of light absorption in a selected region of the visible spectrum as a result of a coupling reaction is a property also exhibited by conventional masking couplers, commonly used in color negative films for color correction. Thus, it is possible to choose the initial absorption of LG as attached to COUP so that the absorption shift on release performs the function of a masking coupler.

LG can take the form of any conventional one equivalent coupler leaving group. One equivalent couplers having leaving groups suitable for use in the image forming layer units of the photographic elements of the invention are described in Lau U.S. Pat. No. 4,248,962 and Mooberry et al U.S. Pat. Nos. 4,840,884, 5,447,819 and 5,457,004, the disclosures of which are here incorporated by reference. The one equivalent image dye-forming couplers of Mooberry et al are preferred, since they do not require mordanting on release to retain their desired hue. Viewed another way, the Mooberry et al one equivalent image dye-forming couplers can contain release dyes that are charge neutral.

Preferred one equivalent image dye-forming couplers include the following components:

$$\text{COUP—L}'_n\text{—B'—N(R}_{23}\text{)—DYE}$$

COUP is the coupler moiety described above, and the structure to the right of COUP forms L'G.

DYE is an image dye or image dye precursor and can include an auxochrome associated with the dye, where an auxochrome is a group that increases dye absorption intensity.

$L'_n$—B' is a linking group that is at least divalent. n is zero or 1. The COUP bond and the B'—$N(R_{23})$ bond are both cleaved under conditions permitting coupling off to occur. Cleaving the B'—$N(R_{23})$ bond bathochromically shifts the hue of the DYE.

B' can be chosen from among —OC(O)—, —OC(S)—, —SC(O)—, —SC(S)— or —OC(=$NSO_2R_{24}$)—, where $R_{24}$ is a substituted or unsubstituted alkyl or aryl group. B' in the form of —OC(=$NSO_2R_{24}$)— and —OC(O)—, particularly the latter, is preferred to maintain the lowest possible densities in unexposed areas.

$N(R_{23})$ either forms a part of the auxochrome or chromophore of DYE. Illustrative groups in which —$N(R_{23})$— forms a part of an auxochrome are as follows:

The nitrogen atom in —$NR_{23}$— is optionally located in an auxochrome, that is a group that intensifies the color of the dye, or it is optionally an integral part of the dye chromophore.

Illustrative groups wherein —$NR_{23}$— is part of auxochrome are as follows:

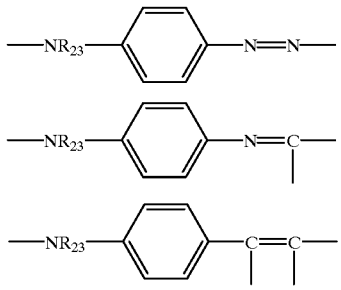

Illustrative groups in which —$N(R_{23})$— forms a part of a dye chromophore are as follows:

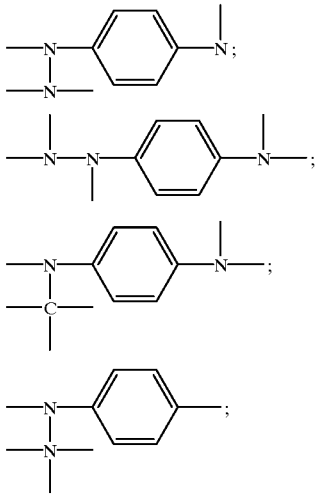

The particular linking group $L'_n$—B' can be varied to help control such parameters as rate and time of release of the —$NR_{23}$— DYE group. The particular linking group $L'_n$—B' employed, including the nature of the substituents on $L'_n$—B', can additionally control the rate and distance of diffusion of the unit formed by the group $L'_n$—B', the —$NR_{23}$— group and the DYE after this unit is released from the coupler moiety but before the —$NR_{23}$— DYE is released. The linking group $L'_n$—B' preferably causes a spectral shift in absorption of DYE as a function of attachment to —$NR_{23}$—. Also, the linking group $L'_n$—B' preferably stabilizes the DYE to oxidation, particularly wherein the —$NR_{23}$— is part of the chromophore.

The coupler moiety COUP can be any moiety which will react with oxidized color developing agent to cleave the bond between the linking group and the coupler moiety. It includes coupler moieties employed in conventional color-forming couplers which yield colorless products on reaction with oxidized color developing agents as well as coupler moieties which yield colored products on reaction with oxidized color developing agents. Both types of coupler moieties are well known to those skilled in the art.

The coupler moiety can be unballasted or ballasted with an oil-soluble or fat-tail group. It can be monomeric, or it can form part of a dimeric, oligomeric or polymeric coupler, in which case more than one $L'_n$—B' —$NR_{23}$— DYE unit can be contained in the coupler.

It will be appreciated that, depending upon the particular coupler moiety, the particular color developing agent and the type of processing, the reaction product of the coupler moiety and oxidized color developing agent can be: (1) colored and nondifflisible, in which case it will remain in the location where it is formed; (2) colored and diffusible, in which case it may be removed during processing from the location where it is formed or allowed to migrate to a different location; or (3) colorless.

The —$L'_n$—B' —$NR_{23}$— DYE unit is joined to the coupler moiety at any of the positions from which groups released from couplers by reaction with oxidized color developing agent can be attached. The —$L'_n$—B' —$NR_{23}$— DYE unit is attached at the coupling position of the coupler moiety so that upon reaction of the coupler with oxidized color developing agent the —$L'_n$—B' —$NR_{23}$— DYE will be displaced.

The linking group $L'_n$—B' can be any organic group which will serve to connect COUP to the —$NR_{23}$— group and which, after cleavage from COUP will cleave from the —$NR_{23}$— group, for example by an elimination reaction of the type described in, for example, U.S. Pat. No. 4,409,323. The elimination reaction involves electron transfer down a conjugated chain. As used herein the term "electron transfer down a conjugated chain" is understood to refer to transfer of an electron along a chain of atoms in which alternate single bonds and double bonds occur. A conjugated chain is understood to have the same meaning as commonly used in organic chemistry. Electron transfer down a conjugated chain is as described in, for example, U.S. Pat. No. 4,409,323.

The group $L'_n$—B' can contain moieties and substituents which will permit control of one or more of the following rates: (i) the rate of reaction of COUP with oxidized color developing agent, (ii) the rate of diffusion of —$L'_n$—B' —$NR_{23}$— DYE and (iii) the rate of release of DYE. The linking group $L'_n$—B' can contain additional substituents or precursors thereof which may remain attached to the linking group or be released.

Illustrative linking groups include:

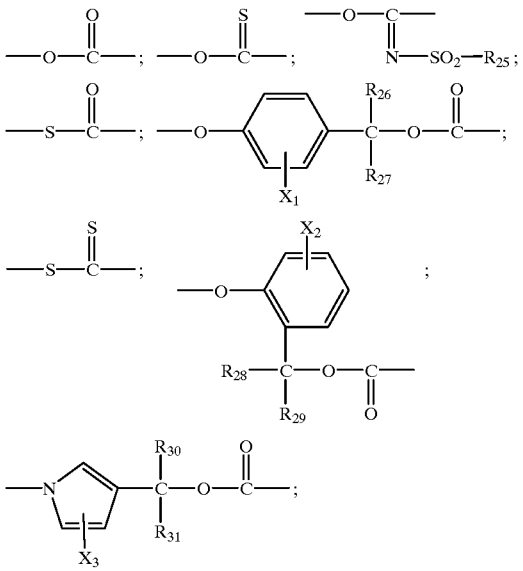

-continued

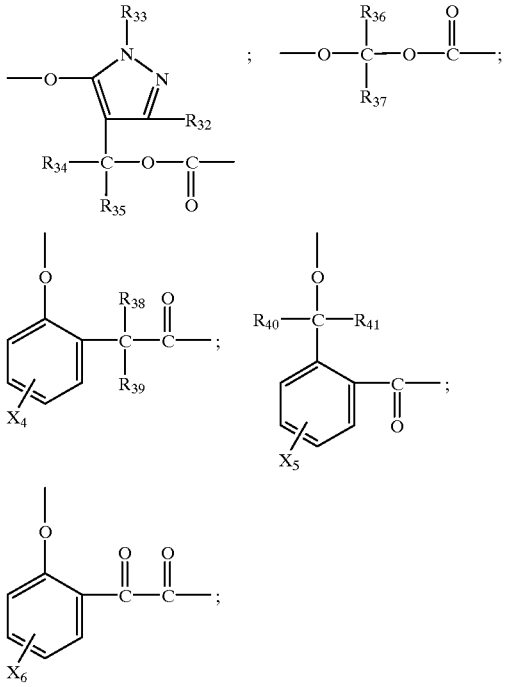

wherein $X_1$ through $X_6$ and $R_{23}$ through $R_{41}$ are substituents that do not adversely affect the described COUP —$L'_n$—B' —$NR_{23}$— DYE. For example, $R_{23}$ through $R_{41}$ are individually hydrogen, unsubstituted or substituted alkyl, such as alkyl containing 1 to 30 carbon atoms, for example, methyl, ethyl, propyl, n-butyl, t-butyl, pentyl and eicosyl; or cycloalkyl, such as cyclopentyl, cyclohexyl and 4-methoxycyclohexyl; or aryl, such as unsubstituted or substituted phenyl. $X_1$ through $X_6$ can be hydrogen or a substituent that does not adversely affect the described COUP —$L'_n$—B' —$NR_{23}$— DYE, such as electron withdrawing or donating groups, for example, alkyl, such as methyl, ethyl, propyl, n-butyl, t-butyl and eicosyl, halogen, such as chlorine and bromine, nitro, carbamyl, acylamido, sulfonamido, sulfamyl, sulfo, carboxyl, cyano, and alkoxy, such as methoxy and ethoxy, acyl, sulfonyl, hydroxy, alkoxycarbonyl, and aryloxy. The linking group $L'_n$—B' can be, for example, a linking group within U.S. Pat. No. 4,409,323 or a nucleophilic displacement type linking group as described in, for example, U.S. Pat. No. 4,248,962, or a linking group which is a combination of these two types.

A particularly useful linking group is:

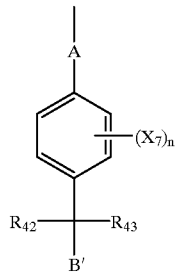

wherein A is O, S, or sulfonamido (N—$SO_2$ $R_{44}$);

B is as previously defined;

$R_{42}$ and $R_{43}$ are individually hydrogen, or substituted or unsubstituted alkyl, such as methyl, ethyl, propyl, n-butyl or t-butyl, or aryl, such as unsubstituted or substituted phenyl; $X_7$ is a substituent as described for $X_1$, that does not adversely affect the coupler; and n is 0, 1, 2, 3 or 4. $R_{44}$ is a substituent, typically alkyl or aryl. Typically $R_{42}$ and $R_{43}$ are hydrogen.

Typically $R_{42}$ and $R_{43}$ are hydrogen.

Preferred $L'_n$—B' linking groups include:

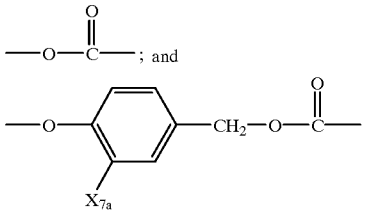

wherein $X_{7a}$ is hydrogen, chlorine, methylsulfonamido ($NHSO_2CH_3$), —$COOCH_3$, —$NHCOCH_3$, —$CONHCH_3$, —$COHNCH_2COOH$, —COOH or $CON(CH_3)_2$.

A particularly useful linking group is represented by the formula:

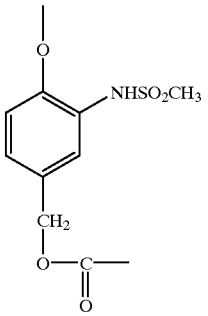

The linking group and DYE optionally contain substituents that can modify the rate of reaction, diffusion, or displacement, such as halogen, including fluoro, chloro, bromo, or iodo, nitro, alkyl of 1 to 20 carbon atoms, acyl, carboxy, carboxyalkyl, alkoxycarbonyl, alkoxycarbonamido, alkylcarbamyl, sulfoalkyl, alkylsulfonamido, and alkylsulfonyl, solubilizing groups, ballast groups and the like. For example, solubilizing groups will increase the rate of diffusion and ballast groups will decrease the rate of diffusion.

The $R_{23}$ substituent on —$NR_{23}$— can be any substituent that does not adversely affect the coupler (A). When the —$NR_{23}$— is part of an auxochrome, $R_{23}$ can be, for example, hydrogen or alkyl, such as alkyl containing 1 to 30 carbon atoms, including methyl, ethyl, propyl, n-butyl, t-butyl or eicosyl, or aryl, such as phenyl. When the nitrogen atom attached to $L'_n$—B' is part of a chromophore, $R_{23}$ becomes an integral part of the chromophore.

Preferred $R_{23}$ groups are alkyl, such as alkyl containing 1 to 18 carbon atoms when $R_{23}$ is part of the dye auxochrome. $R_{23}$ when part of the chromophore is, for example, unsubstituted or substituted aryl, such as phenyl.

The DYE as described includes any releasable, electrically neutral dye that enables dye hue stabilization without mordanting the dye formed. The release mechanism can be initiated by oxidized reducing agent.

The particular DYE and the nature of the substituents on the DYE can control whether or not the dye diffuses and the rate and distance of diffusion of the DYE formed. For example, the DYE can contain a ballast group known in the photographic art that hinders or prevents diffusion. The DYE can contain a water solubilizing group, such as carboxy or sulfonamide groups, to help diffusion of the DYE. Such groups are known to those skilled in the art.

Particularly useful classes of DYE moieties are:

I. Azo dye moieties including the —$NR_{23}$— group represented by the structure:

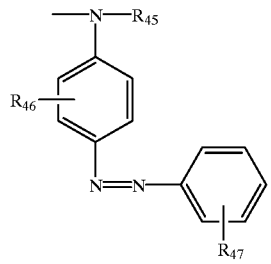

wherein $R_{45}$, $R_{46}$ and $R_{47}$ are individually hydrogen or a substituent, such as alkyl. The aromatic rings containing $R_{46}$ and $R_{47}$ may also be heteroaromatic rings containing one or more ring N atoms.

II. Azamethine dye moieties including the —$NR_{23}$— group represented by the structure:

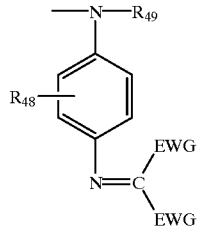

wherein $R_{48}$ is hydrogen or a substituent, such as alkyl; $R_{49}$ is hydrogen or a substituent, such as alkyl; and EWG is an electron withdrawing group.

III. Methine dye moieties including the —$NR_{23}$— group represented by the structure:

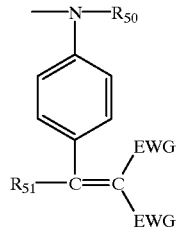

wherein $R_{50}$ is hydrogen or a substituent, such as alkyl; $R_{51}$ is hydrogen or a substituent such as alkyl; and EWG is an electron withdrawing group.

The term DYE also includes dye precursors wherein the described substituted nitrogen atom is an integral part of the chromophore, also described herein as leuco dye moieties. Such dye precursors include, for example:

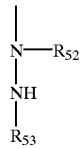

wherein $R_{52}$ and $R_{53}$ are aryl, such as substituted phenyl.

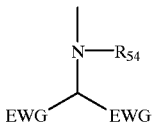

wherein $R_{54}$ is an aryl group, such as substituted phenyl; and EWG is an electron withdrawing group.

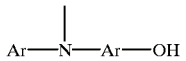

wherein Ar are individually substituted aryl groups, particularly substituted phenyl groups. When the DYE moiety is a leuco dye, $L'_n$—B' preferably comprises a timing group that enables delay of oxidation of the leuco dye by silver halide in a photographic silver halide element. For example, it is preferred that $L'_n$—B' be a

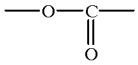

group when DYE is a leuco dye moiety as described.

Examples of cyan, magenta, yellow and leuco dyes are as follows:

A. Cyan

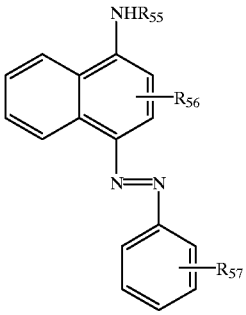

wherein $R_{55}$ is a substituent that does not adversely affect the dye, such as alkyl; $R_{56}$ is a substituent, such as an electron releasing group; and $R_{57}$ is a substituent, such as a strong electron withdrawing group.

B. Magenta

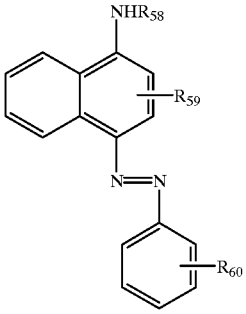

wherein $R_{58}$ is a substituent that does not adversely affect the dye, such as alkyl; $R_{59}$ is a substituent, such as an electron releasing group; and $R_{60}$ is a substituent, such as a strong electron withdrawing group.

C. Yellow

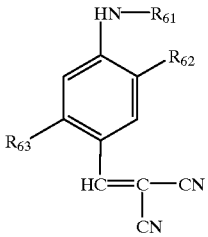

wherein $R_{61}$ is alkyl; $R_{62}$ is alkoxy; and $R_{63}$ is alkyl; and

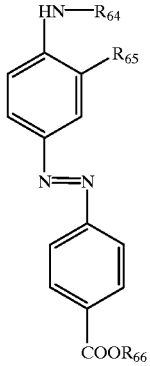

wherein $R_{64}$ is alkyl; $R_{65}$ is alkoxy; and $R_{66}$ is alkyl or aryl.

D. Leuco

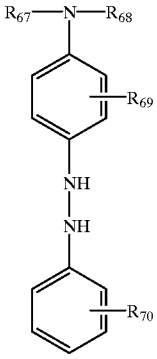

wherein $R_{67}$ and $R_{68}$ are individually hydrogen or alkyl; $R_{69}$ is an electron releasing group; and $R_{70}$ is a strong electron withdrawing group.

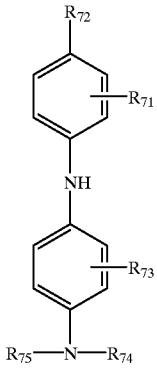

wherein $R_{71}$ and $R_{73}$ are individually hydrogen or a substituent; $R_{72}$ is a hydroxyl, $NHR_{76}$ or NHSO2 $R_{76}$ wherein $R_{76}$ is a substituent; $R_{74}$ and $R_{75}$ are individually hydrogen or a substituent.

The following are specific illustrations of one equivalent image dye-forming couplers contemplated for use in the practice of this invention:

OEC-1

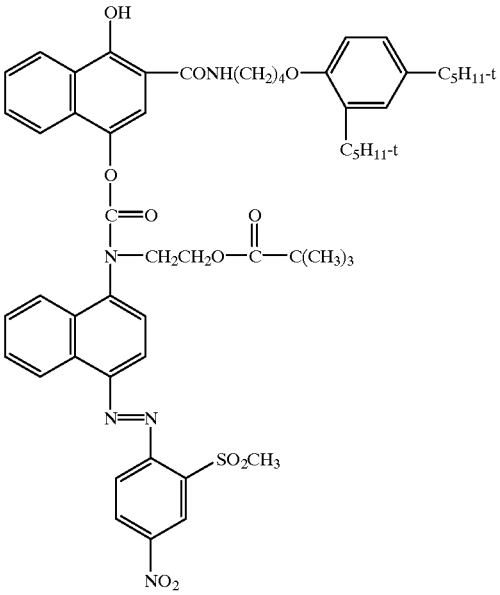

-continued

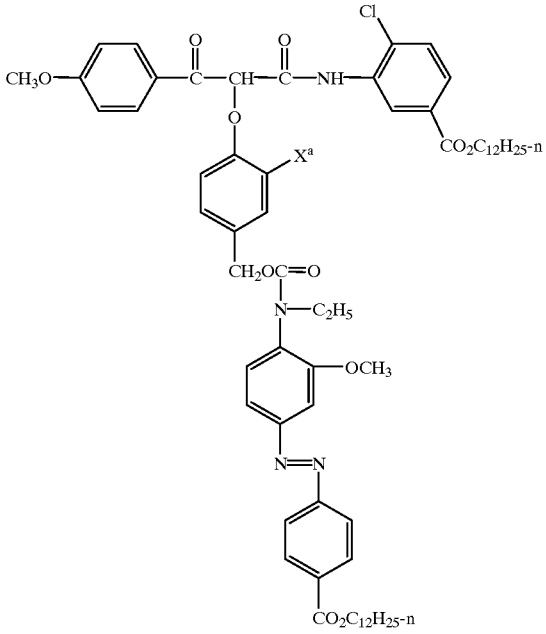

OEC-2

$X^a$=NHCOCH$_3$

OEC-3

$X^a$=NHSO$_2$CH$_3$

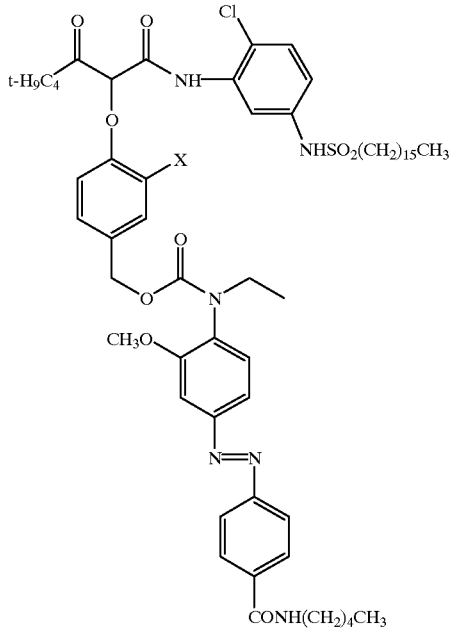

-continued
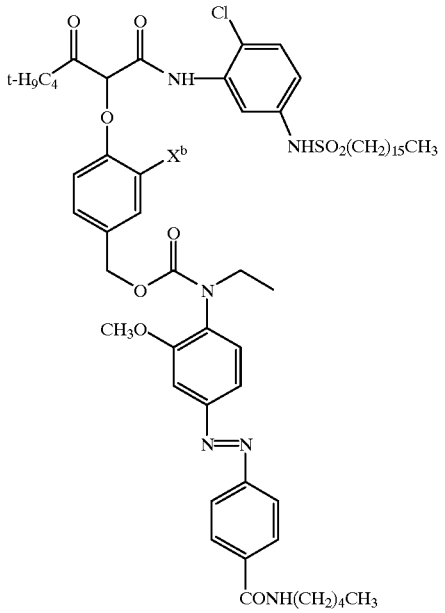
OEC-4
X = 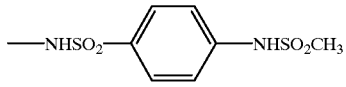
$X^b$ = 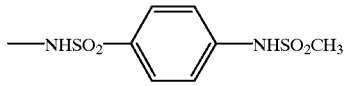
OEC-5
X = 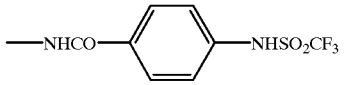
$X^b$ = 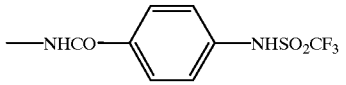
OEC-6
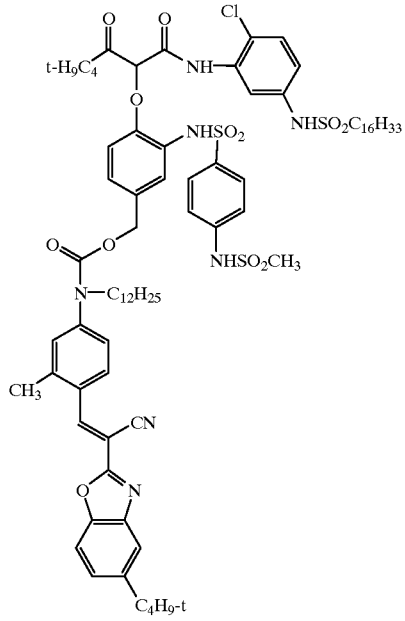
-continued
OEC-7
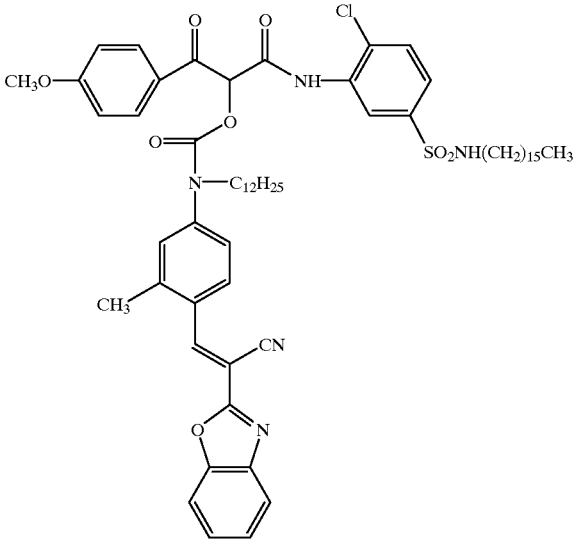
OEC-8
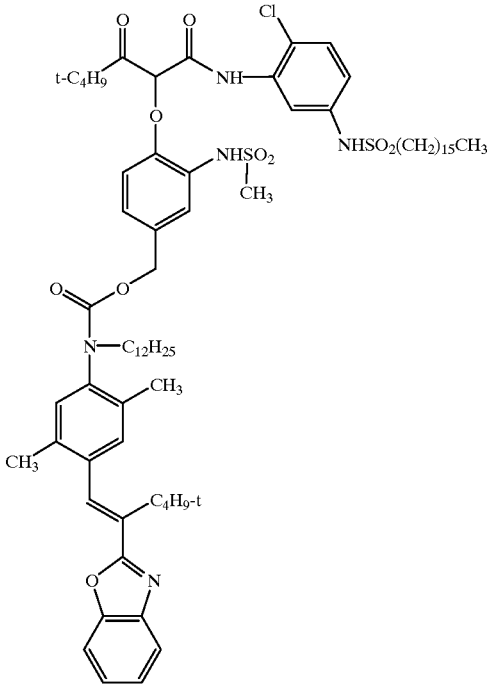

-continued
OEC-9
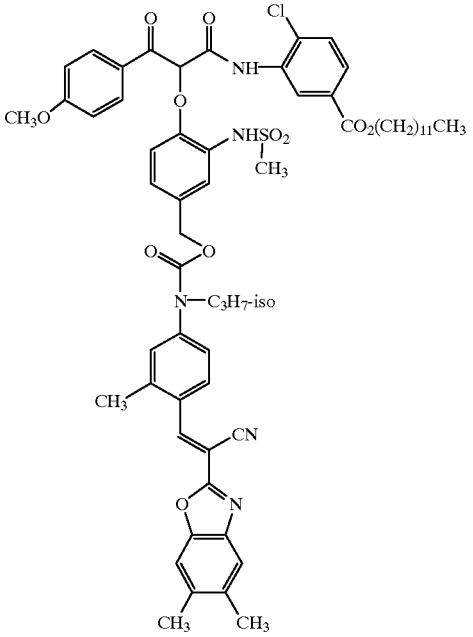
OEC-10
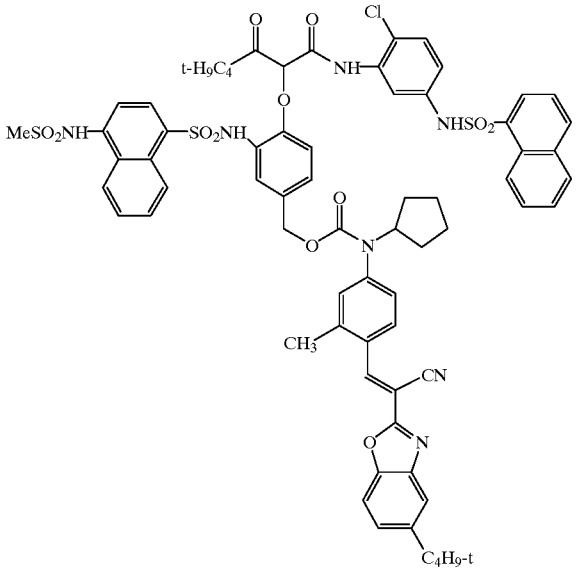
-continued
OEC-11
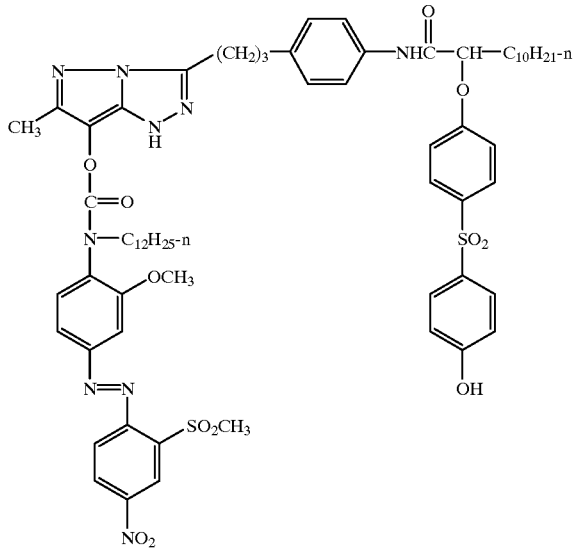
OEC-12
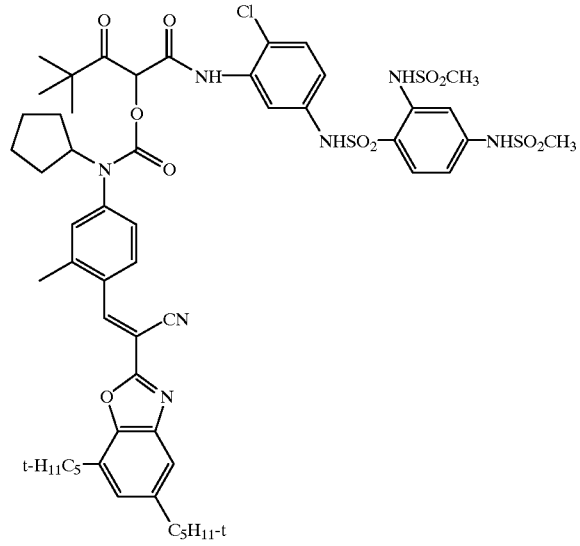
In addition to one equivalent image dye-forming coupler the image forming layer unit can, if desired, contain one or more other conventional couplers. For example, it is contemplated to employ one or more four equivalent or, particularly, two equivalent image dye-forming couplers in combination with an image dye-forming one equivalent coupler. When image dye-forming couplers are used in combination, it is preferred that at least 20 percent on a mole basis of image dye-forming coupler present be provided by one or more one equivalent image dye-forming couplers.

Other couplers that can be present in the photographic element of the invention include, for example:

Couplers which combine with oxidized developer to produce cyan colored dyes are shown, for example, in Weissberger et al U.S. Pat. No. 2,474,293, Vittum et al U.S. Pat. No. 3,002,836, Stecker U.S. Pat. No. 3,041,236, Ono et al U.S. Pat. No. 4,746,602, Kilminster U.S. Pat. No. 4,753,871, Aoki et al U.S. Pat. No. 4,770,988, Kilminster et al U.S. Pat. No. 4,775,616, Hamada et al U.S. Pat. No. 4,818,667, Masukawa et al U.S. Pat. No. 4,818,672, Monbaliu et al U.S. Pat. No. 4,822,729, Monbaliu et al U.S. Pat. No. 4,839,267, Masukawa et al U.S. Pat. No. 4,840,883, Hoke et al U.S. Pat. No. 4,849,328, Miura et al U.S. Pat. No. 4,865,961, Tachibana et al U.S. Pat. No. 4,873,183, Shimada et al U.S. Pat. No. 4,883,746, Tani et al U.S. Pat. No. 4,900,656, Ono et al U.S. Pat. No. 4,904,575, Tachibana et al U.S. Pat. No. 4,916,051, Nakayama et al U.S. Pat. No. 4,921,783, Merkel et al U.S. Pat. No. 4,923,791, Tachibaba et al U.S. Pat. No. 4,950,585, Aoki et al U.S. Pat. No. 4,971,898, Lau U.S. Pat. No. 4,990,436, Masukawa et al U.S. Pat. No. 4,996,139, Merkel U.S. Pat. No. 5,008,180, Wolff U.S. Pat. No. 5,015,565, Tachibana et al U.S. Pat. No. 5,011,765, Kida et al U.S. Pat. No. 5,011,766, Masukawa et al U.S. Pat. No. 5,017,467, Hoke U.S. Pat. No. 5,045,442, Uchida et al U.S. Pat. No. 5,051,347, Kaneko U.S. Pat. No. 5,061,613, Kita et al U.S. Pat. No. 5,071,737, Langen et al U.S. Pat. No. 5,075,207, Fukunada et al U.S. Pat. No. 5,091,297, Tsukahara et al U.S. Pat. No. 5,094,938, Shimada et al U.S. Pat. No. 5,104,783, Fujita et al U.S. Pat. No. 5,178,993, Naito et al U.S. Pat. No. 5,813,729, Ikesu et al U.S. Pat. No. 5,187,057, Tsukahara et al U.S. Pat. No. 5,192,651, Schumann et al U.S. Pat. No. 5,200,305, Yamakawa et al U.S. Pat. No. 5,202,224, Shimada et al U.S. Pat. No. 5,206,130, Ikesu et al U.S. Pat. No. 5,208,141, Tsukahara et al U.S. Pat. No. 5,210,011, Sato et al U.S. Pat. No. 5,215,871, Kita et al U.S. Pat. No. 5,223,386, Sato et al U.S. Pat. No. 5,227,287, Suzuki et al U.S. Pat. No. 5,256,526, Kobayashi et al U.S. Pat. No. 5,258,270, Shimada et al U.S. Pat. No. 5,272,051, Ikesu et al U.S. Pat. No. 5,306,610, Yamakawa U.S. Pat. No. 5,326,682,Shimada et al U.S. Pat. No. 5,366,856, Naruse et al U.S. Pat. No. 5,378,596, Takizawa et al U.S. Pat. No. 5,380,638, Lau et al U.S. Pat. No. 5,382,502, Matsuoka et al U.S. Pat. No. 5,384,236, Takada et al U.S. Pat. No. 5,397,691, Kaneko et al U.S. Pat. No. 5,415,990, Asami U.S. Pat. No. 5,434,034, Tang et al U.S. Pat. No. 5,441,863, Tashiro et al EPO 0 246 616, Lau EPO 0 250 201, Kilminster et al EPO 0 271 323, Sakanoue et al EPO 0 295 632, Mihayashi et al EPO 0 307 927, Ono et al EPO 0 333 185, Shinba et al EPO 0 378 898, Giusto EPO 0 389 817, Sato et al EPO 0 487 111, Suzuki et al EPO 0 488 248, Ikesu et al EPO 0 539 034, Suzuki et al EPO 0 545 300, Yamakawa et al EPO 0 556 700, Shimada et al EPO 0 556 777, Kawai EPO 0 556 858, Yoshioka EPO 0 569 979, Ikesu et al EPO 0 608 133, Merkel et al EPO 0 636 936, Merkel et al EO 0 651 286, Sugita et al EPO 0 690 344, Renner et al German OLS 4,026,903, Langen et al German OLS 3,624,777 and Wolff et al German OLS 3,823,049;

Magenta coupler types are shown, for example, in Porter et al U.S. Pat. Nos. 2,311,082 and 2,369,489, Tuite U.S. Pat. No. 3,152,896, Arai et al U.S. Pat. No. 3,935,015, Renner U.S. Pat. No. 4,745,052, Ogawa et al U.S. Pat. No. 4,762,775, Kida et al U.S. Pat. No. 4,791,052, Wolff et al U.S. Pat. No. 4,812,576, Wolff et al U.S. Pat. No. 4,835,094, Abe et al U.S. Pat. No. 4,840,877, Wolff U.S. Pat. No. 4,845,022, Krishnamurthy et al U.S. Pat. No. 4,853,319, Renner U.S. Pat. No. 4,868,099, Helling et al U.S. Pat. No. 4,865,960, Normandin U.S. Pat. No. 4,871,652, Buckland U.S. Pat. No. 4,876,182, Bowne et al U.S. Pat. No. 4,892,805, Crawley et al U.S. Pat. No. 4,900,657, Furutachi U.S. Pat. No. 4,910,124, Ikesu et al U.S. Pat. No. 4,914,013, Yokoyama et al U.S. Pat. No. 4,921,968, Furutachi et al U.S. Pat. No. 4,929,540, Kim et al U.S. Pat. No. 4,933,465, Renner U.S. Pat. No. 4,942,116, Normandin et al U.S. Pat. No. 4,942,117, Normandin et al U.S. Pat. No. 4,942,118, Normandin et al U.S. Pat. No. 4,959,480, Shimazaki et al U.S. Pat. No. 4,968,594, Ishige et al U.S. Pat. No. 4,988,614, Bowne et al U.S. Pat. No. 4,992,361, Renner et al U.S. Pat. No. 5,002,864, Bums et al U.S. Pat. No. 5,021,325, Sato et al U.S. Pat. No. 5,066,575, Morigaki et al U.S. Pat. No. 5,068,171, Ohya et al U.S. Pat. No. 5,071,739, Chen et al U.S. Pat. No. 5,100,772, Harder et al U.S. Pat. No. 5,110,942, Kimura et al U.S. Pat. No. 5,116,990, Yokoyama et al U.S. Pat. No. 5,118,812, Kunitz et al U.S. Pat. No. 5,134,059, Mizukawa et al U.S. Pat. No. 5,155,016, Romanet et al U.S. Pat. No. 5,183,728, Tang et al U.S. Pat. No. 5,234,805, Sato et al U.S. Pat. No. 5,235,058, Krishnamurthy et al U.S. Pat. No. 5,250,400, Ikenoue et al U.S. Pat. No. 5,254,446, Krishnamurthy et al U.S. Pat. No. 5,262,292, Matsuoka et al U.S. Pat. No. 5,300,407, Romanet et al U.S. Pat. No. 5,302,496, Daifuku et al U.S. Pat. No. 5,336,593, Singer et al U.S. Pat. No. 5,350,667, Tang U.S. Pat. No. 5,395,968, Helling et al U.S. Pat. No. 5,354,826, Tang et al U.S. Pat. No. 5,358,829, Ishidai et al U.S. Pat. No. 5,368,998, Krishnamurthy et al U.S. Pat. No. 5,378,587, Mizukawa et al U.S. Pat. No. 5,409,808, Signer et al U.S. Pat. No. 5,411,841, Wolff U.S. Pat. No. 5,418,123, Tang U.S. Pat. No. 5,424,179, Numata et al EPO 0 257 854, Bowne et al EPO 0 284 240, Webb et al EPO 0 341 204, Miura et al EPO 347,235, Yukio et al EPO 365,252, Yamazaki et al EPO 0 422 595, Kei EPO 0 428 899, Tadahisa et al EPO 0 428 902, Hieechi et al EPO 0 459 331, Sakanoue et al EPO 0 467 327, Kida et al, EPO 0 476 949, Kei et al, EPO 0 487 081, Wolfe EPO 0 489 333, Coraluppi et al EPO 0 512 304, Hirabayashi et al EPO 0 515 128, Harabayashi et al EPO 0 534 703, Sato et al EPO 0 554 778, Tang et al EPO 0 558 145, Mizukawa et al EPO 0 571 959, Schofield et al EPO 0 583 832, Schofield et al EPO 0 583 834, Hirabayashi et al EPO 0 584 793, Tang et al EPO 0 602 748, Tang et al EPO 0 602 749, Lau et al EPO 0 605 918, Allway EPO 0 622 672, Allway EPO 0 622 673, Kita et al EPO 0 629 912, Kapp et al EPO 0 646 841,Kita et al EPO 0 656 561, Ishidai et al EPO 0 660 177, Tanaka et al EPO 0 686 872, Thomas et al WO 90/10253, Williamson et al WO 92/09010, Leyshon et al, WO 92/10788, Crawley et al WO 92/12464, Williamson WO 93/01523, Merkel et al WO 93/02392, Krishnamurthy et al WO 93/02393, Williamson WO 93/07534, UK Patent Application 2,244,053, Japanese Patent Application 03192-350, Renner German OLS 3,624,103, Wolff et al German OLS 3,912,265, and Werner et al German OLS 40 08 067; and Compounds useful for forming yellow colored dyes upon coupling with oxidized color developer include, for example, Weissberger U.S. Pat. No. 2,298,443, Okumura et al U.S. Pat. No. 4,022,620, Buckland et al U.S. Pat. No. 4,758,501, Ogawa et al U.S. Pat. No. 4,791,050, Buckland et al U.S. Pat. No. 4,824,771, Sato et al U.S. Pat. No. 4,824,773, Renner et al U.S. Pat. No. 4,855,222, Tsoi U.S. Pat. No. 4,978,605, Tsuruta et al U.S. Pat. No. 4,992,360, Tomotake et al U.S. Pat. No. 4,994,361, Leyshon et al U.S.

Pat. No. 5,021,333, Masukawa U.S. Pat. No. 5,053,325, Kubota et al U.S. Pat. No. 5,066,574, Ichijima et al U.S. Pat. No. 5,066,576, Tomotake et al U.S. Pat. No. 5,100,773, Lau et al U.S. Pat. No. 5,118,599, Kunitz U.S. Pat. No. 5,143,823, Kobayashi et al U.S. Pat. No. 5,187,055, Crawley U.S. Pat. No. 5,190,848, Motoki et al U.S. Pat. No. 5,213,958, Tomotake et al U.S. Pat. No. 5,215,877, Tsoi U.S. Pat. No. 5,215,878, Hayashi U.S. Pat. No. 5,217,857, Takada et al U.S. Pat. No. 5,219,716, Ichijima et al U.S. Pat. No. 5,238,803,Kobayashi et al U.S. Pat. No. 5,283,166, Kobayashi et al U.S. Pat. No. 5,294,531,Mihayashi et al U.S. Pat. No. 5,306,609, Fukuzawa et al U.S. Pat. No. 5,328,818, Yamamoto et al U.S. Pat. No. 5,336,591, Saito et al U.S. Pat. No. 5,338,654, Tang et al U.S. Pat. No. 5,358,835, Tang et al. U.S. Pat. No. 5,358,838, Tang et al U.S. Pat. No. 5,360,713, Morigaki et al U.S. Pat. No. 5,362,617, Tosaka et al U.S. Pat. No. 5,382,506, Ling et al U.S. Pat. No. 5,389,504, Tomotake et al U.S. Pat. No. 5,399,474, Shibata U.S. Pat. No. 5,405,737, Goddard et al U.S. Pat. No. 5,411,848, Tang et al U.S. Pat. No. 5,427,898, Himmelmann et al EPO 0 327 976, Clark et al EPO 0 296 793, Okusa et al EPO 0 365 282, Tsoi EPO 0 379 309, Kida et al EPO 0 415 375, Mader et al EPO 0 437 818, Kobayashi et al EPO 0 447 969, Chino et al EPO 0 542 463, Saito et al EPO 0 568 037, Tomotake et al EPO 0 568 196, Okumura et al EPO 0 568 777 and Yamada et al EPO 0 570 006, Kawai EPO 0 573 761, Carmack et al EPO 0 608 956, Carmack et al EPO 0 608 957, Mooberry et al EPO 0 628 865.

The 3D, core/shell silver halide emulsion containing a one-equivalent coupler and a fragmentable electron donating compound in accordance with this invention may be spectrally sensitized by the use of a spectral sensitizing dye, as is well known to one of skill in the art. Preferred sensitizing dyes that can be used are cyanine, merocyanine, styryl, hemicyanine, or complex cyanine dyes. Illustrative dyes that can be used include those dyes disclosed in U.S. Pat. Nos. 5,747,235 and 5,747,236, the entire disclosures of which are incorporated herein by reference.

The sensitization of the silver halide with the sensitizing dyes may be carried out by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

The emulsion layer of the photographic element of the invention can comprise any one or more of the light sensitive layers of the photographic element. The photographic elements made in accordance with the present invention are multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which is preferably transparent.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support).

The present invention also contemplates the use of photographic elements of the present invention in what are often referred to as single use cameras (or "film with lens" units). Single use cameras are well known and typically comprise (1) a plastic inner camera shell including a taking lens, a film metering mechanism, and a simple shutter and (2) a paper-cardboard outer sealed pack which contains the inner camera shell and has respective openings for the taking lens and for a shutter release button, a frame counter window, and a film advance thumbwheel on the camera shell. The camera may also have a flash unit to provide light when the picture is taken. The inner camera shell has front and rear viewfinder windows located at opposite ends of a see-through viewfinder tunnel, and the outer sealed pack has front and rear openings for the respective viewfinder windows. At the manufacturer, the inner camera shell is loaded with a film cartridge, and substantially the entire length of the unexposed filmstrip is factory prewound from the cartridge into a supply chamber of the camera shell. After the customer takes a picture, the thumbwheel is manually rotated to rewind the exposed frame into the cartridge. The rewinding movement of the filmstrip the equivalent of one frame rotates a metering sprocket to decrement a frame counter to its next lower numbered setting. When substantially the entire length of the filmstrip is exposed and rewound into the cartridge, the single-use camera is sent to a photofinisher who first removes the inner camera shell from the outer sealed pack and then removes the filmstrip from the camera shell. The filmstrip is processed, and the camera shell and the opened pack are thrown away or, preferably, recycled.

In the following discussion of suitable materials for use in elements of this invention, reference will be made to *Research Disclosure,* September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,41 1; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

Various other compounds may be added to the photographic material of the present invention for the purpose of lowering the fogging of the material during manufacture, storage, or processing. Typical antifoggants are discussed in Section VI of Research Disclosure I, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

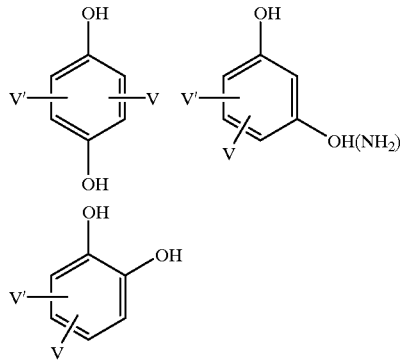

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, —$CH_2CH_2COOH$, —$CH_3$, —$CH_2CH_3$, —$C(CH_3)_3$, —$OCH_3$, —CHO, —$SO_3K$, —$SO_3Na$, —$SO_3H$, —$SCH_3$, or -phenyl.

Especially preferred hydroxybenzene compounds follow:

HB1

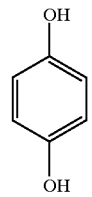

-continued

HB2

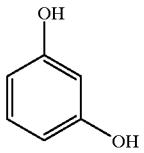

HB3

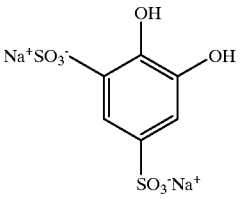

HB4

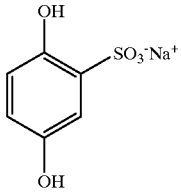

HB5

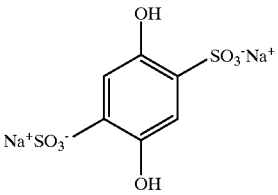

HB6

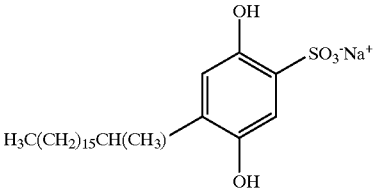

HB7

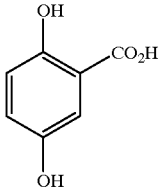

HB8

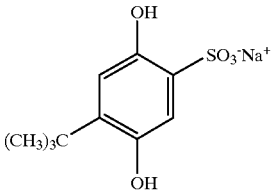

HB9

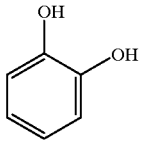

-continued

HB10

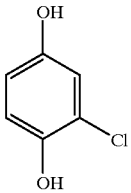

HB11

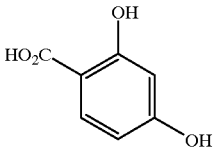

HB12

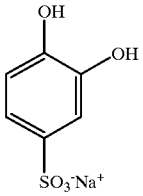

HB13

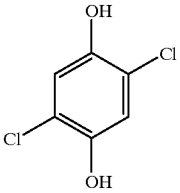

HB14

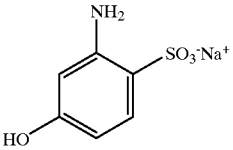

HB15

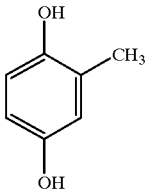

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor,

*The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol. 116, December, 1973, Item 11660, and Bissonette Research Disclosure, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

EMULSION EXAMPLES

Emulsion E-1

This is a core/shell emulsion prepared as follows: Into a reaction vessel with good mixing was added 6.8 L of distilled water, 196 g of lime-processed, bone gelatin, 233.2 g of sodium bromide, 34 g of potassium iodide and antifoamant and, while keeping the temperature at 53° C., an aqueous solution consisting of 1.405 M silver nitrate was added at the rate of 125 ml/min for 23.46 min simultaneously with the addition of a solution consisting of 2.466 M sodium bromide containing 0.154 M potassium iodide and added at the rate of 141.7 ml/min. The addition of halide solution was then terminated and the addition of silver nitrate solution was continued for an additional 23.46 min. The vessel temperature was raised to 76° C. over a period of 11.5 min and an aqueous solution of 19 g of sodium thiocyanate in 28 ml was then added. After a hold time of 25 min the vessel was cooled to 45° C. and the excess salts were removed by ultrafiltration. The yield was 8.24 moles of a core/shell emulsion containing 8.2% iodide and with an average size of 1.04 μm. X-ray diffraction analysis revealed a core region containing 14% iodide and a shell region containing 5% iodide.

Emulsion E-2

This is a core/shell emulsion prepared in the following manner: Into a reaction vessel with good mixing was added 32.2 g of lime-processed, bone gelatin, 68 g of sodium bromide, 4.43 L of distilled water, and antifoamant. The vessel was brought to a temperature of 75° C., 0.421 moles of silver iodide Lippmann seeds were added, and the vessel was held with good mixing for 4 min. Nucleation was initiated with 0.5 M silver nitrate addition at 20 g/min for 9 s. The silver flow was then ramped to 40 g/min in 9 min.

Growth was conducted by simultaneously adding 0.5 M silver nitrate and 0.55 M sodium bromide at linearly accelerated flows from 0.4 to 0.7 and from 0.1 to 1.0 g/min, respectively, for 21.8 min. Growth was then continued with 1.25 M silver nitrate and 1.75 M sodium bromide at flows from 0.3 to 0.4 and a constant 0.3 g/min, respectively, for 5.9 min, from 0.4 to 1.1 and 0.3 to 1.0 g/min, respectively, for 25 min. The pBr was then driven to 2.13 by adding silver nitrate only from 1.1 to 1.4 g/min over 9 min, then from 1.4 to 0.8 g/min over 7.7 min. Silver nitrate and sodium bromide were then added at a constant rate of 0.5 and 0.4 g/min, respectively, for 13.9 min. Following cool down to 45° C., the emulsion was ultrafiltered to remove excess salt to yield 11.8 moles of a core/shell emulsion containing 13.9% iodide with an average size of 1.40 um. X-ray diffraction revealed a core of 39% iodide with three additional iodide regions of 15, 9, and 5 % iodide.

Emulsion E-3

This is a core/shell emulsion prepared as follows: Into a reaction vessel with good stirring was added 5 L of distilled water, 166 g of lime-processed, bone gelatin, 545 g of sodium bromide, 50 g of potassium iodide and antifoamant. The vessel was brought to 80° C. and nucleation was conducted by adding 2.352 M silver nitrate containing 137 mg/l mercuric chloride at a linearly accelerated flow rate from 28.3 to 41.3 ml/min. 0.06 moles of ammonium sulfate were added followed by 0.126 moles of sodium hydroxide. After 1.5 min the ammonia was neutralized with 0.2 N sulfuric acid to pH 5.4. Growth was initiated with silver nitrate added simultaneously with a solution consisting of 1.963 M sodium bromide containing 1.474 M potassium iodide. Flow rates were ramped linearly from 41.3 to 85.0 and from 18.3 to 37.7 ml/min, respectively, for 30.7 min. For a period of 25.6 min the silver flow was held at 85.0 ml/min while the salt flow was ramped linearly from 19.3 to 50.0 ml/min using 3.905 M sodium bromide. 192 mg of ruthenium hexacyanide was then added over a period of 8.5 min while the silver flow remained at 85.0 ml/min and the salt flow increased from 50.1 to 60.3 m/min. Growth was continued with the silver flow at 85.0 and the salt flow increasing from 60.3 to 77.0 ml/min. Following cool down to 45° C., the emulsion was ultrafiltered to remove excess salt yielding 14.9 moles with an average grain size of 2.20 um and containing 9.0% iodide. X-ray diffraction revealed a core of 24% iodide with three additional iodide regions of 20, 7, and 2% iodide.

TABLE 1

| Emulsion | Grain Diameter μm | Number of Iodide Phases | Core Region Mole % | % Iodide in Core | % Iodide in Shell | Total Iodide % |
|---|---|---|---|---|---|---|
| | Emulsion Characteristics | | | | | |
| E1 | 1.04 | 2 | 36 | 13.9 | 5.1 | 8.2 |
| E2 | 1.40 | 4 | 17 | 39.3 | 4.6 | 13.9 |
| E3 | 2.20 | 4 | 15 | 23.9 | 1.7 | 9.0 |

Emulsion Sensitization

The chemical sensitization of each emulsion was formulated to give the optimum speed/fog performance.

Example 1

Emulsion E-1 was treated sequentially with potassium chloride; sodium thiocyanate; finish modifier, FM; yellow sensitizing dye, Dye 1; gold sulfide; sulfur sensitizer, SS, as described by Burgmaier et al in U.S. Pat. No. 4,810,626; and gold sensitizer, GS, as described by Deaton in U.S. Pat. No. 5,049,485. The emulsion was then incubated for 12 min at 62° C. Following cooling to 40° C., the emulsion was treated with antifoggants, AF-1 and AF-2. The sensitized emulsion was evaluated in the format as described below and in Table 3.

Example 2

Emulsion E-1 sensitized as described in Example 1 was evaluated in the format as described below and in Table 3.

Example 3

Emulsion E-1 sensitized as described in Example 1 was evaluated in the format as described below and in Table 3.

Example 4

Emulsion E-1 sensitized as described in Example 1 was evaluated in the format as described below and in Table 3.

Example 5

Emulsion E-2 was treated sequentially with potassium chloride; sodium thiocyanate; yellow sensitizing dye, Dye 1; sodium thiosulfate; aurous dithiosulfate and finish modifier, FM. The emulsion was then incubated for 8 min at 66° C. Following cooling to 40° C., the emulsion was treated with antifoggant, AF-2. The sensitized emulsion was evaluated in the format as described below and in Table 3.

Example 6

Emulsion E-2 sensitized as described in Example 5 was evaluated in the format as described below and in Table 3.

Example 7

Emulsion E-2 sensitized as described in Example 5 was evaluated in the format as described below and in Table 3.

Example 8

Emulsion E-2 sensitized as described in Example 5 was evaluated in the format as described below and in Table 3.

Example 9

Emulsion E-3 was treated sequentially with potassium chloride; sodium thiocyanate; aurous dithiosulfate; sodium thiosulfate; and finish modifier, FM. The emulsion was then incubated for 25 min at 63° C. Following cooling to 40° C., the emulsion was treated with yellow sensitizing dye, Dye 1, followed by antifoggant, AF-2. The sensitized emulsion was evaluated in the format as described below and in Table 3.

Example 10

Emulsion E-3 sensitized as described in Example 9 was evaluated in the format as described below and in Table 3.

Example 11

Emulsion E-3 sensitized as described in Example 9 was evaluated in the format as described below and in Table 3.

Example 12

Emulsion E-3 sensitized as described in Example 9 was evaluated in the format as described below and in Table 3.

Example 13

Emulsion E-3 sensitized as described in Example 9 was evaluated in the format as described below and in Table 3.

Chemical Structures

FM

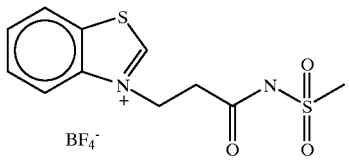

GS

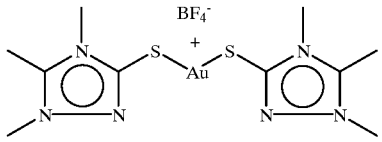

SS

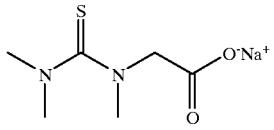

AF-1

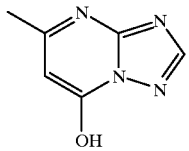

AF-2

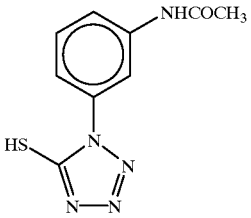

-continued

C-1

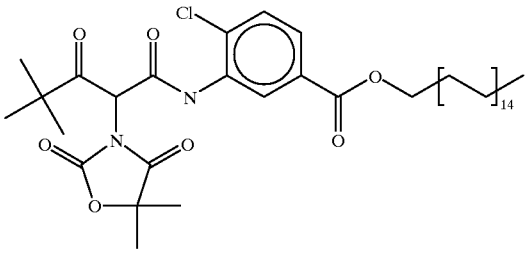

C-2

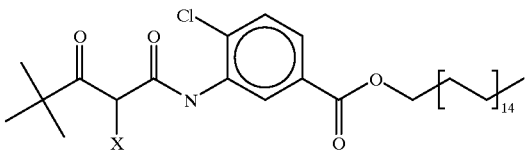

X =

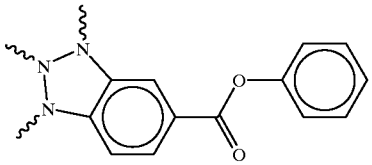

C-3

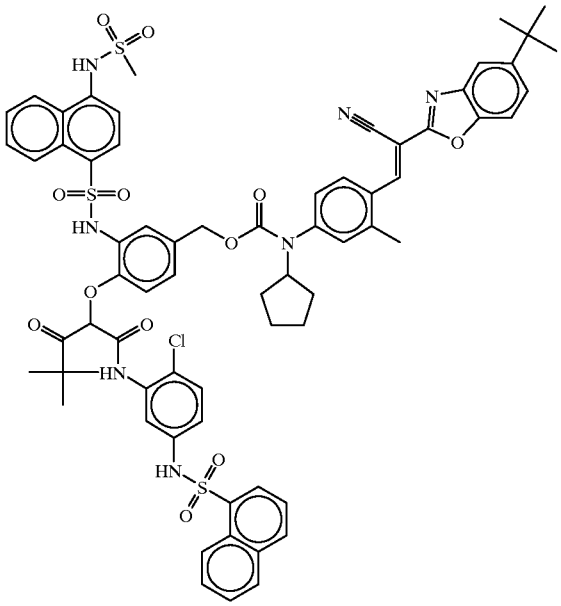

Photographic Evaluation

The FED compound was added to sensitized emulsions by first melting the emulsion at 40° C., adding the FED compound, and then stirring the emulsion for 5 min prior to coating. The sensitized emulsion samples with and without a FED compound were coated in a simple single layer format which consisted of a pad of gelatin on a cellulose acetate film support with an antihalation backing covered by a layer containing the emulsion and the yellow image forming coupler, C-1, together with a yellow development inhibitor releasing coupler, C-2, or alternatively, C-1, was replaced by the one equivalent yellow image forming coupler, C-3. The emulsion layer was protected from abrasion by a gelatin overcoat containing hardener. A detailed description of the layered structure is described in Table 2.

TABLE 2

Coating Format

| Coated Layer | Composition |
|---|---|
| Protective Overcoat | 2.15 g/m$^2$ gelatin |
| Emulsion/Coupler | 3.23 g/m$^2$ gelatin |
| | 0.86 g/m$^2$ Ag |
| | 1.08 g/m$^2$ coupler C-1 + |
| | 0.032 g/m$^2$ coupler C-2 or |
| | 0.647 g/m$^2$ coupler C-3 + |
| | 0.048 g/m$^2$ coupler C-2 |
| | 0.004 g/m$^2$ antifoggant AF-2 |
| Gelatin Pad | 4.89 g/m$^2$ gelatin |
| Support | Cellulose Acetate |

The data shown in Table 3 demonstrate that in the case of 3 different types of core/shell emulsions varying in size and the amount of incorporated iodide, the combination of the fragmentable electron donating compound, FED 2, with the one-equivalent image dye-forming coupler, C-3, provided greatly improved speed and contrast. The increase in speed seen is larger than what can be obtained with either the FED compound or the one-equivalent coupler alone. In the case of contrast, the addition of the FED compound to the one-equivalent coupler gives a significant speed increase without appreciably reducing the large improvement in contrast brought about by the coupler.

TABLE 3

Comparison of Photographic Responses for A Common Coupler vs. One Equivalent Coupler

| Example | Emulsion | Coupler | FED 2 nmol/m$^2$ | Speed | Contrast | Speed Change | Contrast Change % |
|---|---|---|---|---|---|---|---|
| 1 (comparison) | E-1 | C-I | 0 | 285 | 0.554 | | |
| 2 (comparison) | E-1 | C-1 | 9.4 | 286 | 0.524 | 1 | −5 |
| 3 (comparison) | E-1 | C-3 | 0 | 309 | 1.152 | 24 | 108 |
| 4 (invention) | E-1 | C-3 | 9.4 | 314 | 1.115 | 29 | 101 |
| 5 (comparison) | E-2 | C-1 | 0 | 270 | 0.359 | | |
| 6 (comparison) | E-2 | C-1 | 13.2 | 277 | 0.341 | 7 | −5 |

TABLE 3-continued

Comparison of Photographic Responses for A Common Coupler vs. One Equivalent Coupler

| Example | Emulsion | Coupler | FED 2 nmol/m$^2$ | Speed | Contrast | Speed Change | Contrast Change % |
|---|---|---|---|---|---|---|---|
| 7 (comparison) | E-2 | C-3 | 0 | 305 | 0.735 | 35 | 116 |
| 8 (invention) | E-2 | C-3 | 13.2 | 314 | 0.696 | 44 | 104 |
| 9 (comparison) | E-3 | C-I | 0 | 283 | 0.792 | | |
| 10 (comparison) | E-3 | C-1 | 3.5 | 299 | 0.806 | 16 | 2 |
| 11 (comparison) | E-3 | C-3 | 0 | 289 | 1.369 | 6 | 73 |
| 12 (invention) | E-3 | C-3 | 3.5 | 312 | 1.560 | 29 | 97 |
| 13 (invention) | E-3 | C-3 | 10.6 | 319 | 1.528 | 36 | 93 |

Note: Levels of FED 2 are expressed as the amount of active ingredient per unit surface area of the emulsion. D-min is the minimum optical density measured in an unexposed region of the film. Speeds were measured as 100(1-logH) where H is the exposure in lux-sec necessary to produce a density 0.15 above D-min. The Reference for Speed and Contrast Changes is the Example using the control coupler (C-1) with no FED compound present.

The invention has been described in detail with particular reference to certain preferred embodiments thereof, but it will be understood that variations and modifications can be effected within the spirit and scope of the invention.

What is claimed is:

1. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said emulsion layers comprises a) an emulsion with 3D, core/shell grains of at least 0.40 $\mu$m average diameter having a high iodide content in the core of the grain with a shell containing a lesser amount of iodide, b) a one-equivalent image-dye forming coupler, and c) a fragmentable electron donating compound of the formula: X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y'; and, optionally, 3) the radical $X^{\bullet}$ has an oxidation potential $\leqq -0.7$V (that is, equal to or more negative than about −0.7V).

2. A photographic element according to claim 1, wherein the silver halide content of the core comprises from about 5 to about 40% silver iodide.

3. A photographic element according to claim 1, wherein the silver halide content of the shell region is 0 to about 10% silver iodide.

4. A photographic element according to claim 1, wherein the core volume is about 5 to about 60% of the total grain volume.

5. A photographic element according to claim 1, wherein the emulsion size is at least 1.0 um average diameter.

6. A photographic element according to claim 1, wherein the layer containing the the fragmentable electron donating compound is a blue sensitive layer.

7. A photographic element according to claim 1, wherein the one-equivalent coupler is of the formula:

$$COUP—L'_n—B'—N(R_{23})—DYE$$

wherein

COUP is an image dye-forming coupler moiety;

DYE is an image dye or image dye precursor;

B' is —OC(O)—, —OC(S)—, —SC(O)—, —SC(S)— or —OC(=$NSO_2R_{24}$)—, where $R_{24}$ is a substituted or unsubstituted alkyl or aryl group;

L' is a linking group;

n is zero or 1; and

R' is an alkyl or aromatic group.

8. A photographic element according to claim 7, wherein COUP is a cyan dye forming moiety of the formula:

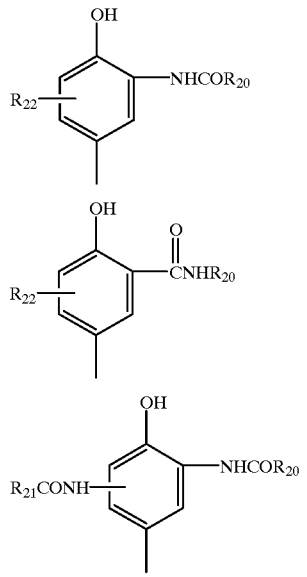

-continued

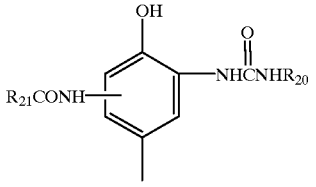

or

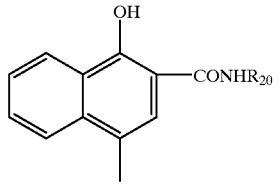

wherein $R_{20}$ and $R_{21}$ represent a ballast group or a substituted or unsubstituted alkyl or aryl group, and $R_{22}$ represents one or more halogen atoms or alkyl or alkoxy groups.

9. A photographic element according to claim 7, wherein COUP is a magenta dye forming moiety of the formula:

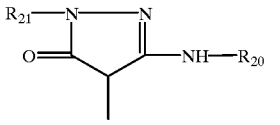

or

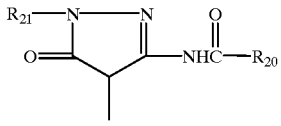

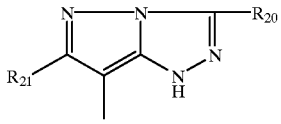

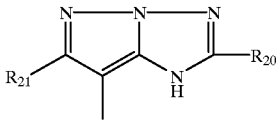

and

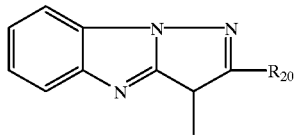

wherein $R_{20}$ and $R_{21}$ represent a ballast group or a substituted or unsubstituted alkyl or aryl group.

10. A photographic element according to claim 7, wherein COUP is a yellow-dye forming moiety of the formula:

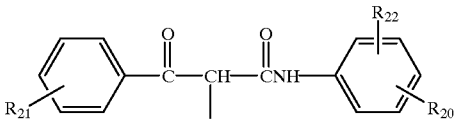

or

-continued

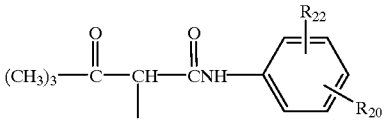

wherein $R_{20}$ and $R_{21}$ represent a ballast group or a substituted or unsubstituted alkyl or aryl group, or hydrogen, alkoxy, alkoxycarbonyl, alkanesulfonyl, arenesulfonyl, aryloxycarbonyl, carbonamido, carbamoyl, sulfonamido, or sulfamoyl, and $R_{22}$ represents one or more halogen atoms or alkyl, alkoxy or ballast groups.

11. A photographic element according to claim 7, wherein COUP is a yellow-dye forming moiety of the formula:

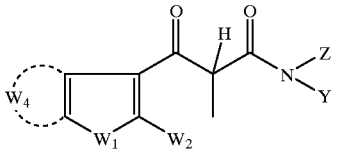

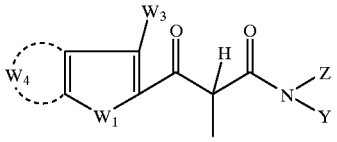

wherein:

$W_1$ is a heteroatom or heterogroup;

$W_2$ is H, or a substituent group;

$W_3$ is H, or a substituent group;

$W_4$ represents the atoms necessary to form a fused ring with the ring containing $W_1$; and Y and Z are independently H or a substituent group.

12. A photographic element according to claim 7, wherein COUP is a yellow-dye forming moiety of the formula:

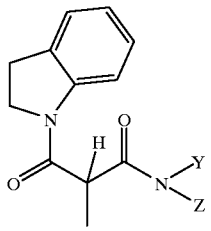

or

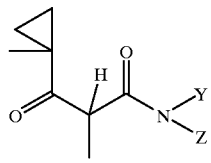

wherein Y and Z are independently H or a substituent group.

13. A photographic recording element according to claim 7, wherein B' is —OC(O)—.

14. A photographic recording element according to claim 7, wherein n is zero.

15. A photographic element according to claim 7, wherein n is 1.

16. A photographic element according to claim 7, wherein L' selected from the following groups:

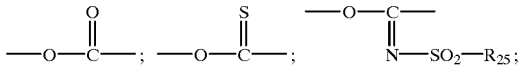

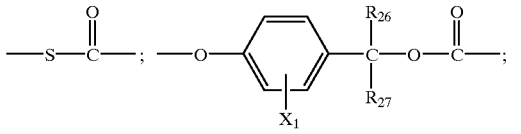

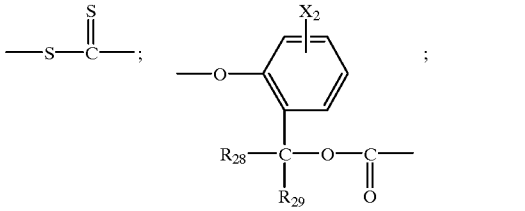

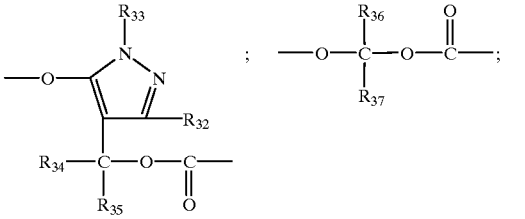

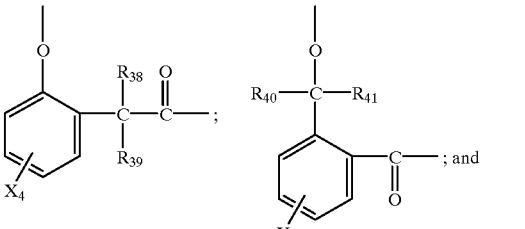

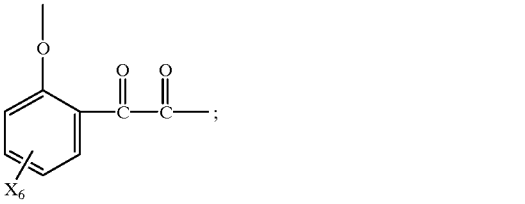

wherein $R_{25}$ through $R_{41}$ are individually a hydrogen atom or an unsubstituted or substituted alkyl, cycloalkyl, or aryl group, and $X_1$ through $X_6$ are individually a hydrogen halogen atom or a substituted or unsubstituted alkyl, nitro, carbamyl, acylamido, sulfonamido, sulfamyl, sulfo, carboxyl, cyano, alkoxy, or aryloxy group.

17. A photographic recording element according to claim 7, wherein DYE is an azomethine or methine dye.

18. A photographic element according to claim 17, wherein DYE is an azomethine dye.

19. A photographic element according to claim 1, wherein the one equivalent coupler is of the formula:

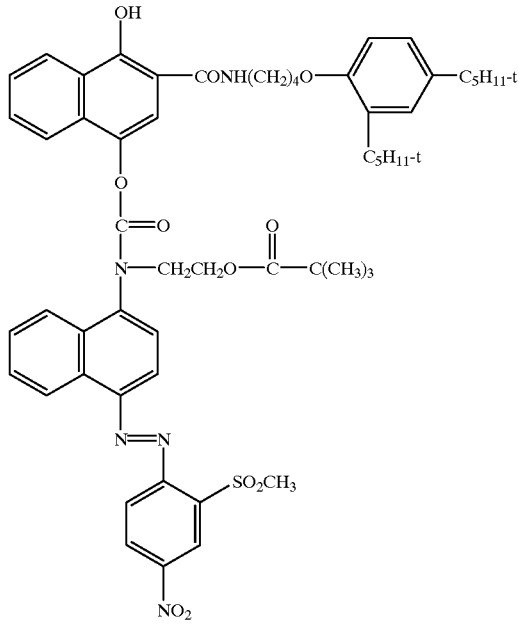

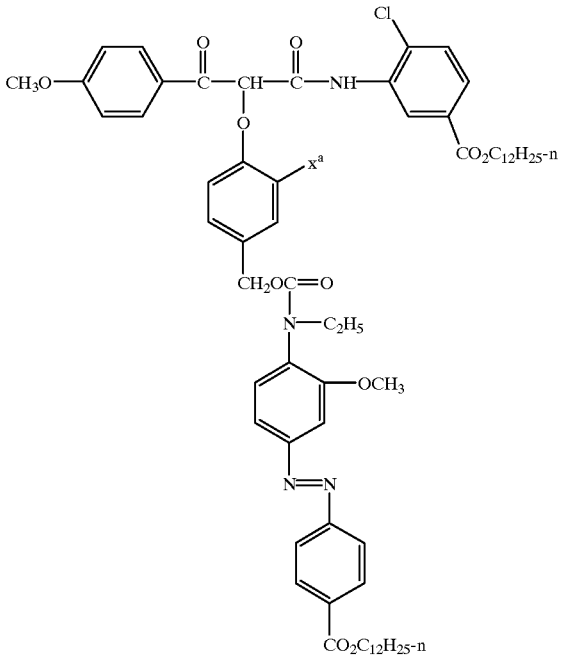

$X^a$═NHCOCH$_3$ $X^a$═NHSO$_2$CH$_3$

-continued
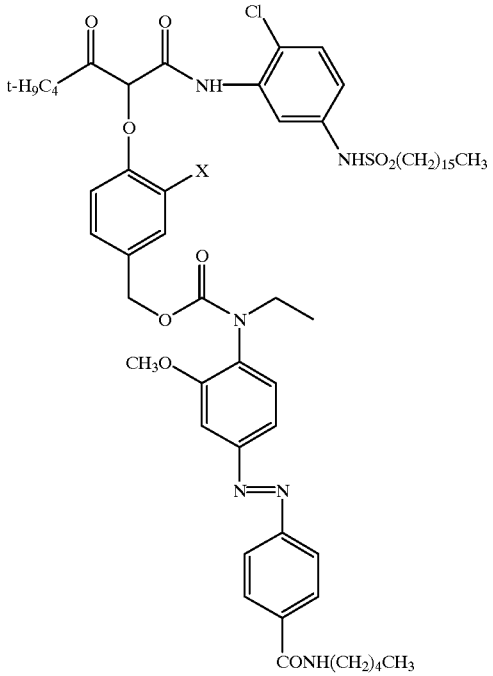
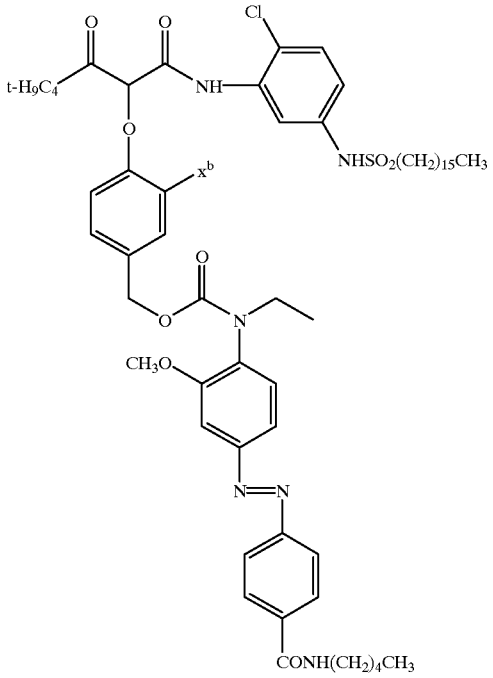
x = 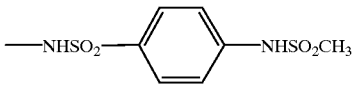
$x^b$ = 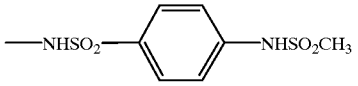
-continued
x = 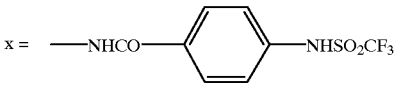
$x^b$ = 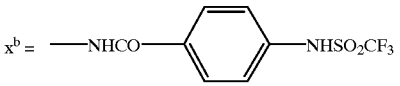
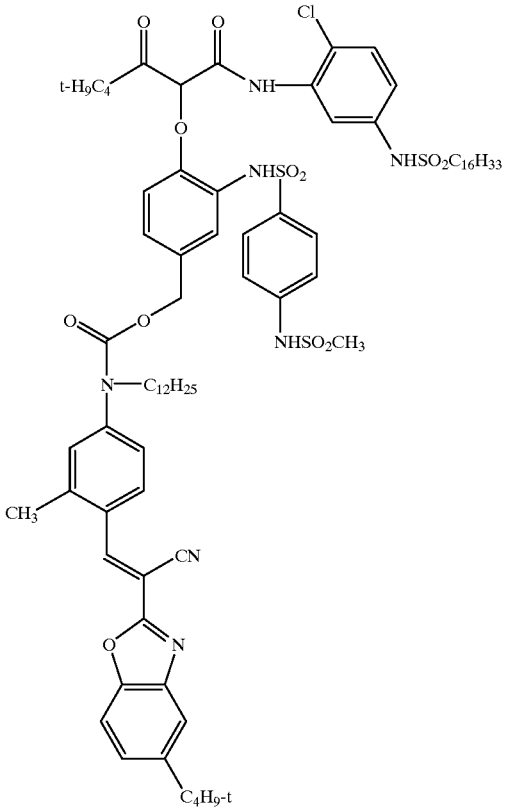
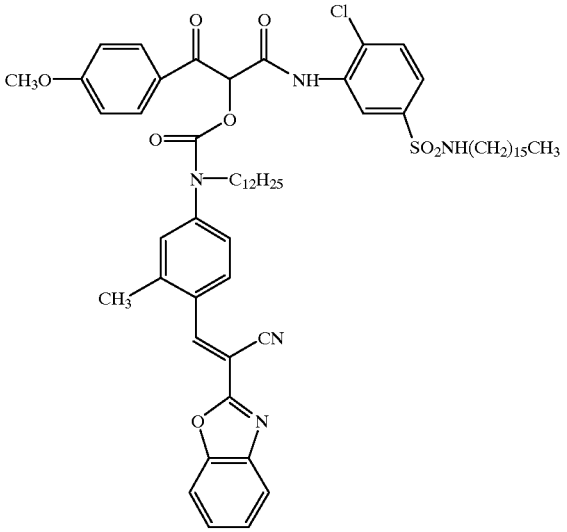

-continued
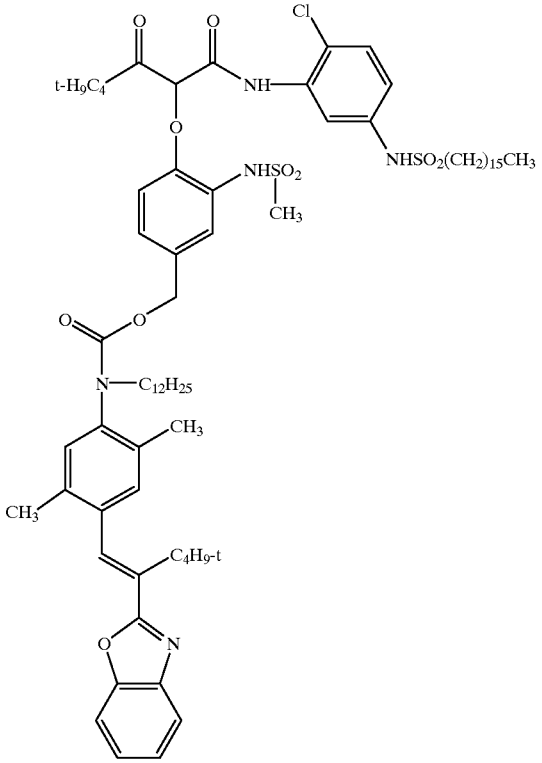
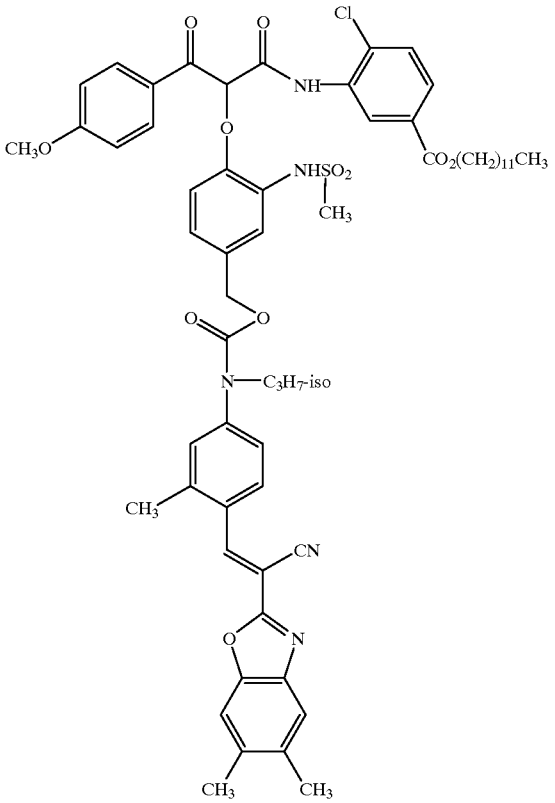
-continued
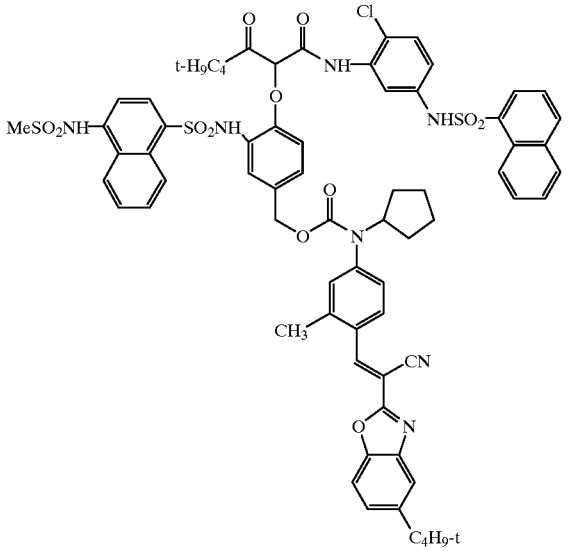
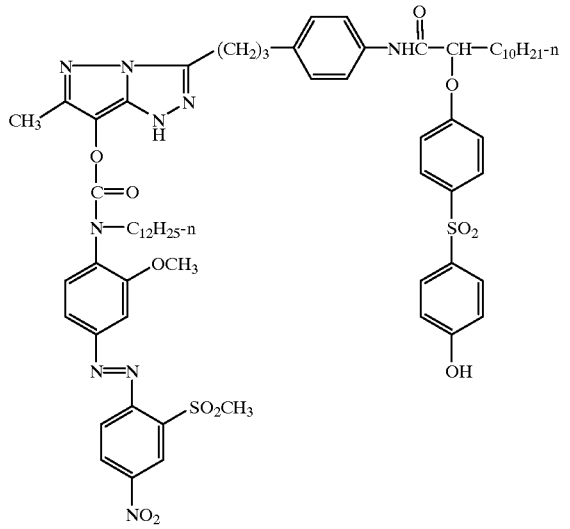
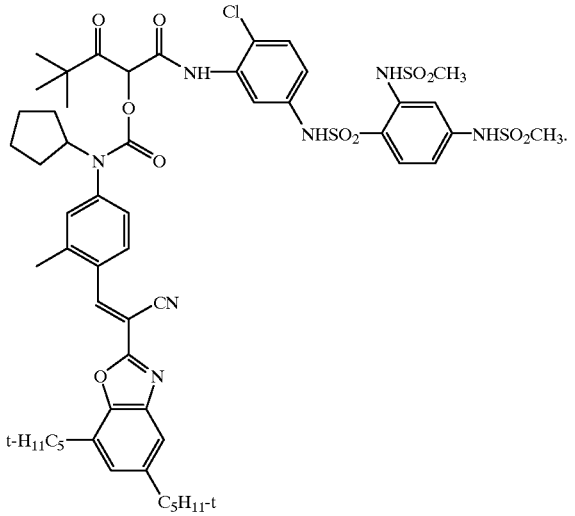
20. A photographic element according to claim 1, wherein X is of structure (I):

(I)

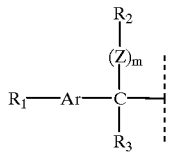

wherein $R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-wherein:

m=0, 1;

Z=O, S, Se, Te;

$R_2$ and Ar=can be linked to form 5- to 8-membered ring;

$R_3$ and Ar=can be linked to form 5- to 8-membered ring;

Ar'=aryl groupor heterocyclic group; and

R=a hydrogen atom or an unsubstituted or substituted alkyl group.

21. A photographic element according to claim 20, wherein the compound of Structure (I) is selected from:

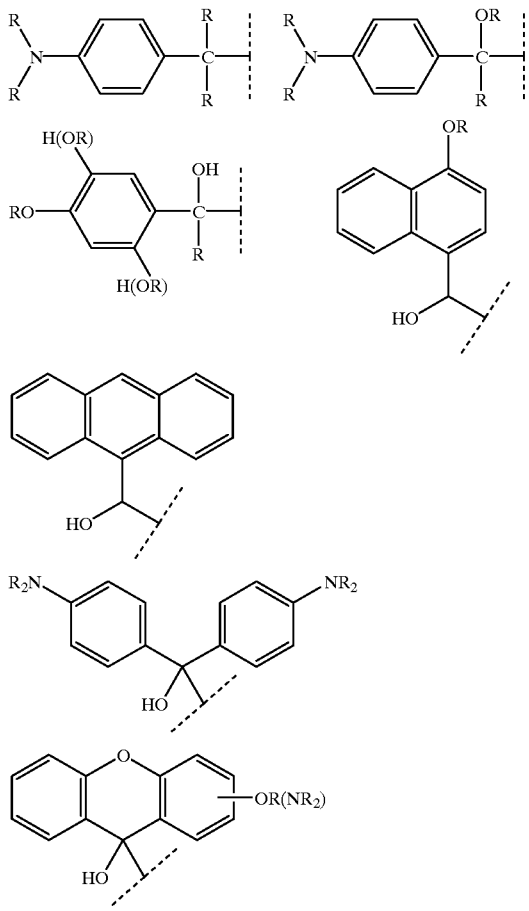

-continued

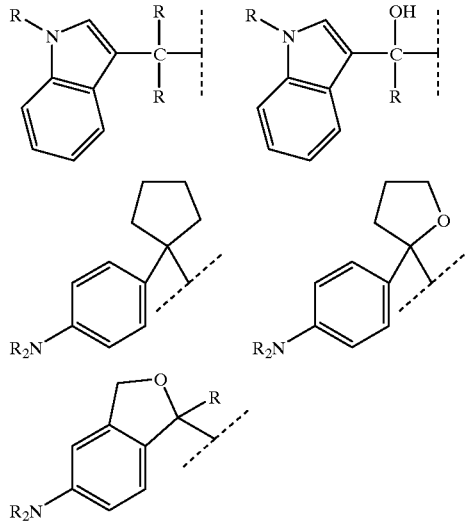

wherein each R is independently a hydrogen atom or a substituted or unsubstituted alkyl group.

22. A photographic element according to claim 1, wherein X is a compound of structure (II):

(II)

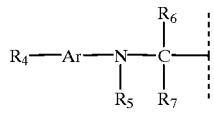

wherein:

Ar=aryl group or heterocyclic group $R_4$=a substituent having a Hammett sigma value of −1 to +1, $R_5$=R or Ar'

$R_6$ and $R_7$=R or Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group or heterocyclic group;

and

R=hydrogen atom or an unsubstituted or substituted alkyl group.

23. A photographic element according to claim 22, wherein X is selected from:

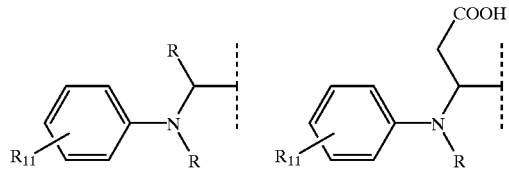

-continued

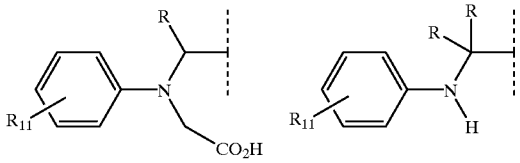

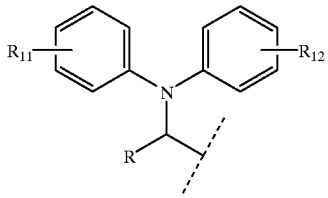

$R_{11}$ and $R_{12}$ =

| | |
|---|---|
| H | carboxyl |
| alkyl | amido |
| alkoxy | formyl |
| alkylthio | sulfonyl |
| halo | sulfonamido |
| carbamoyl | nitrile |

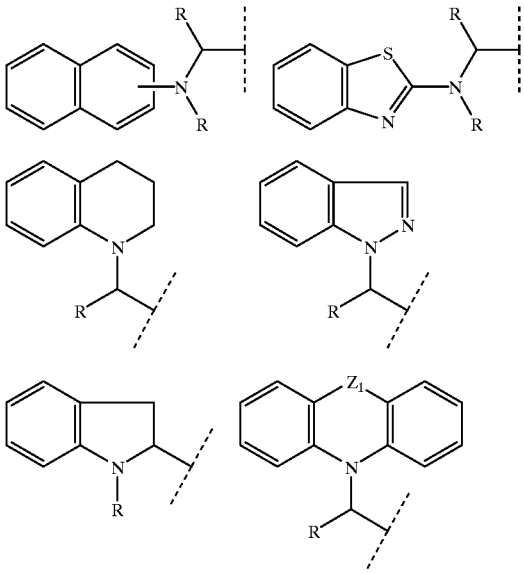

$Z_1$=a covalent bond, S, O, Se, NR, $CR_2$, CR═CR, or $CH_2CH_2$.

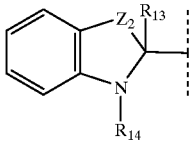

$Z_2$=S, O, Se, NR, $CR_2$, CR═CR, $R_{13}$,=alkyl, substituted alkyl or aryl, and $R_{14}$=H, alkyl substituted alkyl or aryl.

24. A photographic element according to claim 1, wherein X is a compound of structure (III):

(III)

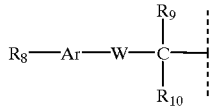

wherein:

W=O, S, Se;

Ar=aryl group or heterocyclic group;

$R_8$=R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group or heterocyclic group;

and

R=a hydrogen atom or an unsubstituted or substituted alkyl group.

25. A photographic element according to claim 24, wherein X is selected from:

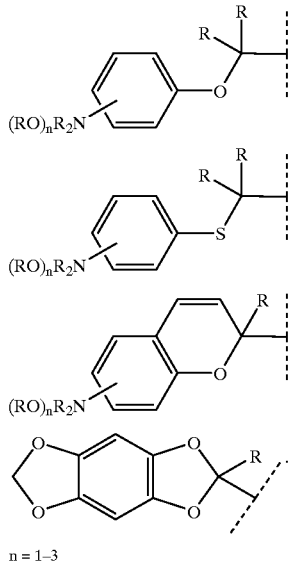

26. A photographic element according to claim 1, wherein X is of structure (IV):

(IV)

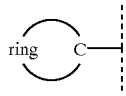

wherein:

"bring" represents a substituted or unsubstituted 5-, 6- or 7-membered unsaturated ring.

27. A photographic element according to claim 26, wherein X is selected from:

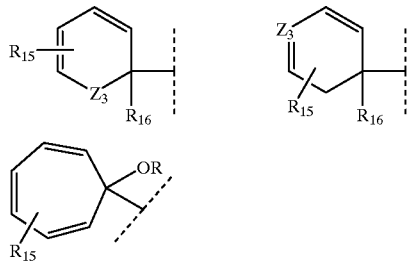

$Z_3$=O, S, Se, NR $R_{15}$=R, OR, $NR_2$ $R_{16}$=alkyl, substituted alkyl.

28. A photographic element according to claim 1, wherein Y' is:

(1) X', where X' is an X group as defined in structures I–IV and may be the same as or different from the X group to which it is attached (2) 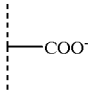

(3) 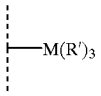

where M=Si, Sn or Ge; and R'=alkyl or substituted alkyl (4) 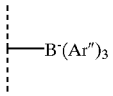

where Ar"=aryl or substituted aryl (5) 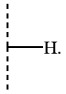

29. A photographic element according to claim 1, wherein the fragmentable electron donor compound is selected from compounds of the $Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k—X—Y'$ wherein:

Z is a light absorbing group;

k is 1 or 2;

A is a silver halide adsorptive group;

L represents a linking group containing at least one C, N, S, P or O atom;

and

Q represents the atoms necessary to form a chromophore comprising an amidinium-ion, a carboxyl-ion or dipolar-amidic chromophoric system when conjugated with X—Y'.

30. A photographic element according to claim 29, wherein the fragmentable electron donor compound is of the formula:

$Z—(L—X—Y')_k$ $Z—(X—Y')_k$ or $(Z)_k—X—Y'$ wherein Z is derived from a cyanine dye, complex cyanine dye, merocyanine dye, complex merocyanine dye, homopolar cyanine dye, styryl dye, oxonol dye, hemioxonol dye, or hemicyanine dye.

31. A photographic element according to claim 29, wherein the fragmentable electron donor compound is of the formula:

$A—(L—X—Y')_k$ $(A—L)_k—X—Y'$ $A—(X—Y')_k$ or $(A)_k—X—Y'$ wherein: A is a silver-ion ligand moiety or a cationic surfactant moiety.

32. A photographic element according to claim 29, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

33. A photographic element according to claim 29, wherein the fragmentable electron donor compound is of the formula:

$Q—X—Y'$ wherein Q represents a chromophoric system comprisisng a cyanine, complex cyanine, hemicyanine, merocyanine, or complex merocyanine dye.

34. A photographic element according to claim 1, wherein the fragementable electron donor compound is selected from the group consisting of:

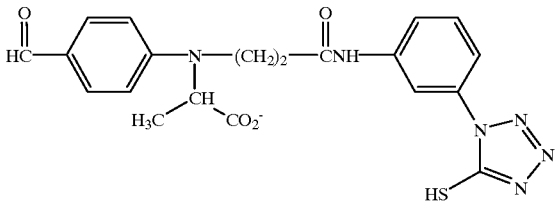
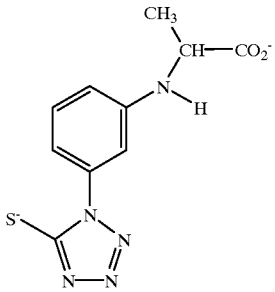
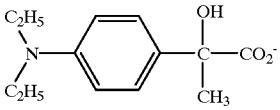
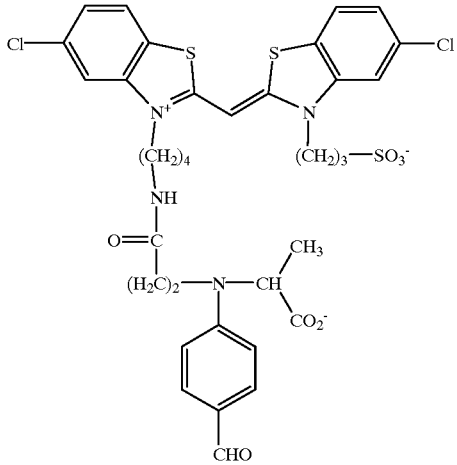
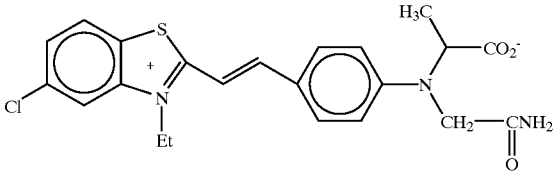
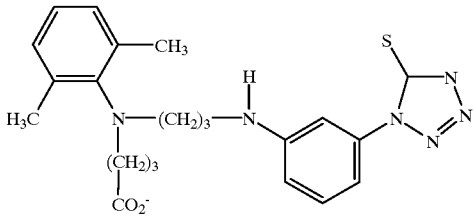
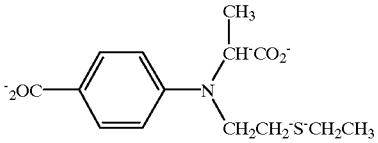
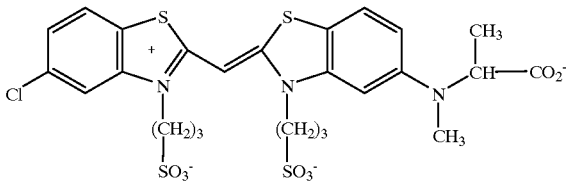
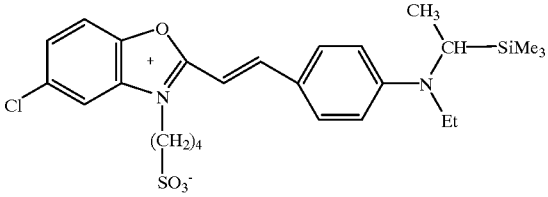
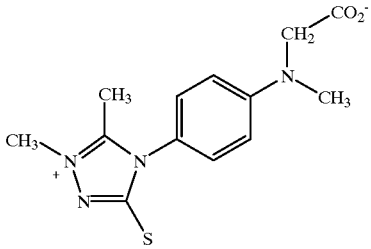
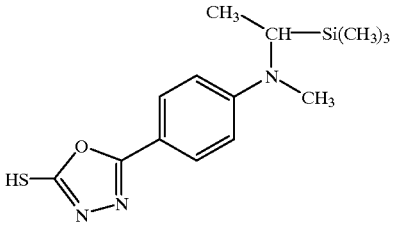
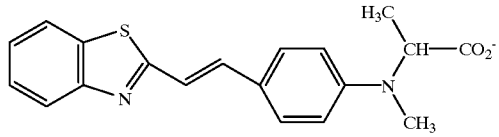

-continued
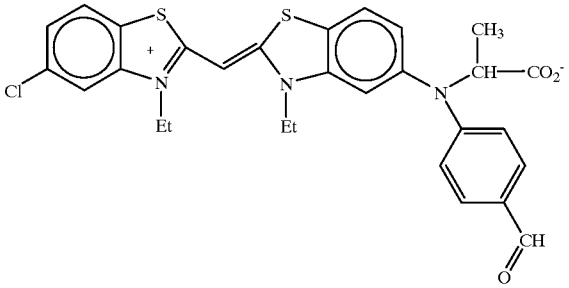
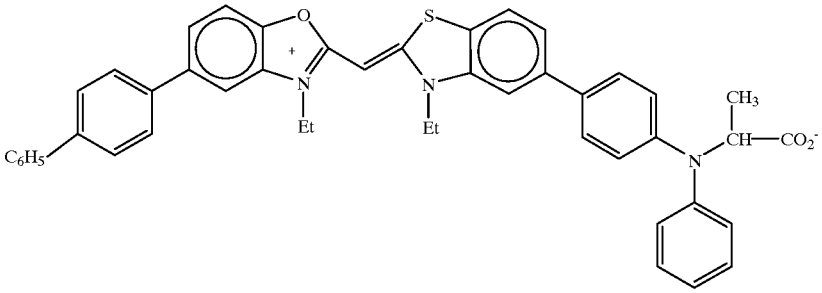
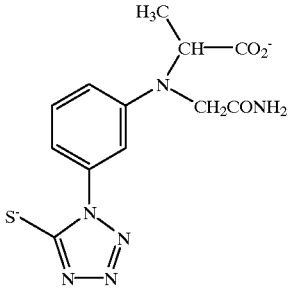
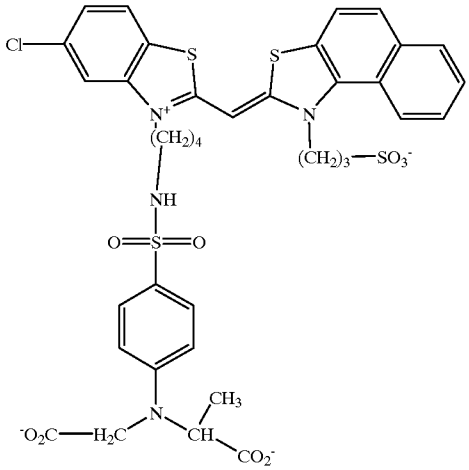
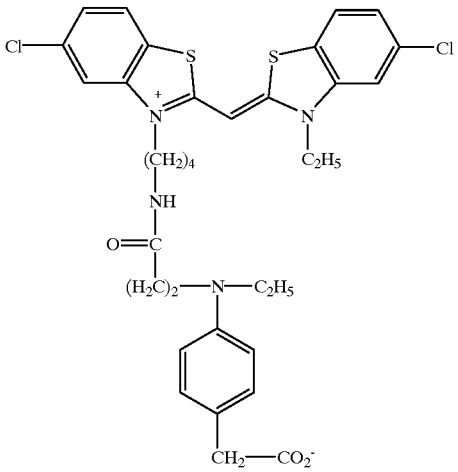
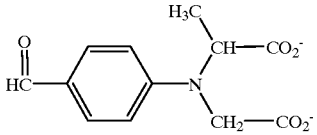

-continued
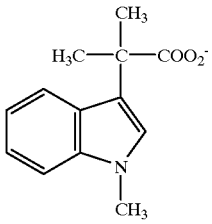
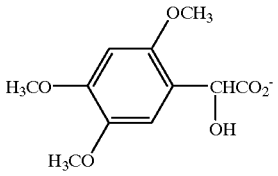
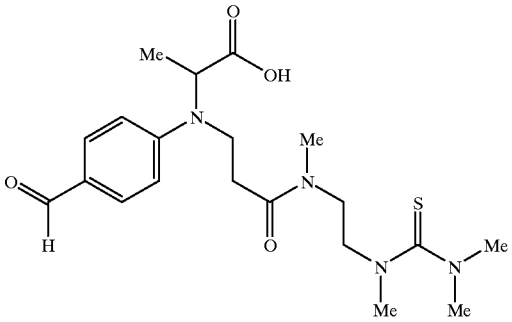
and
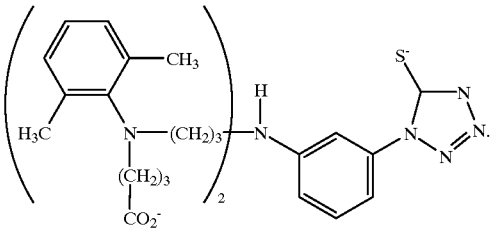
* * * * *